US009833877B2

(12) United States Patent
Ramanath et al.

(10) Patent No.: US 9,833,877 B2
(45) Date of Patent: Dec. 5, 2017

(54) BONDED ABRASIVE ARTICLE AND METHOD OF GRINDING

(71) Applicants: SAINT-GOBAIN ABRASIVES, INC., Worcester, MA (US); SAINT-GOBAIN ABRASIFS, Conflans-Sainte-Honorine (FR)

(72) Inventors: Srinivasan Ramanath, Holden, MA (US); William H. Lane, Princeton, MA (US); Rachana Upadhyay, Shrewsbury, MA (US); Michael P. Hitchiner, Ann Arbor, MI (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 5 days.

(21) Appl. No.: 14/231,066

(22) Filed: Mar. 31, 2014

(65) Prior Publication Data

US 2014/0298729 A1 Oct. 9, 2014

Related U.S. Application Data

(60) Provisional application No. 61/806,913, filed on Mar. 31, 2013.

(51) Int. Cl.
*B24D 3/10* (2006.01)

(52) U.S. Cl.
CPC ..... *B24D 3/10* (2013.01)

(58) Field of Classification Search
CPC ... B24D 7/14; B24D 3/02; B24D 3/04; B24D 3/20
See application file for complete search history.

(56) References Cited

U.S. PATENT DOCUMENTS 2,811,430 A 10/1957 Gregor et al.
2,892,811 A 6/1959 Irany
(Continued)

FOREIGN PATENT DOCUMENTS

CN 101450463 A 6/2009
CN 101896316 A 11/2010
(Continued)

OTHER PUBLICATIONS

International Search Report from PCT/US2013/078225 dated May 1, 2014, 1 page.
(Continued)

*Primary Examiner* — Pegah Parvini
(74) *Attorney, Agent, or Firm* — Abel Law Group, LLP; Joseph P. Sullivan

(57) ABSTRACT

An abrasive article configured to grind a workpiece having a fracture toughness of at least about 5.5 MPa·m$^{0.5}$ may include a body comprising abrasive particles contained within a bond material comprising a metal, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive particles have an average particle size of at least about 1 micron and not greater than about 20 microns.

14 Claims, 3 Drawing Sheets

(56) References Cited

U.S. PATENT DOCUMENTS 2,939,777 A 6/1960 Gregor et al.
2,940,841 A 6/1960 Gregor et al.
3,203,775 A 8/1965 Cantrell
3,510,994 A 5/1970 Amero et al.
3,535,832 A 10/1970 Amero
3,547,609 A 12/1970 Gerry
3,594,141 A 7/1971 Houston et al.
3,650,715 A 3/1972 Brushek et al.
3,664,819 A 5/1972 Sioui et al.
4,010,583 A 3/1977 Highberg
4,024,675 A 5/1977 Naidich et al.
4,042,347 A 8/1977 Sioui
4,063,909 A 12/1977 Mitchell
4,399,167 A * 8/1983 Pipkin ..... C04B 20/1055 427/217
4,802,895 A 2/1989 Burnand et al.
4,923,490 A 5/1990 Johnson et al.
5,011,514 A * 4/1991 Cho ..... B01J 3/062 51/293
5,035,723 A 7/1991 Kalinowski et al.
5,048,235 A 9/1991 Smith
5,173,091 A 12/1992 Marek
5,221,294 A 6/1993 Carman et al.
5,385,591 A 1/1995 Ramanath et al.
5,429,648 A 7/1995 Wu
5,556,438 A 9/1996 Kardys et al.
5,637,123 A 6/1997 Ishizaki et al.
5,658,194 A 8/1997 Micheletti
5,738,696 A * 4/1998 Wu ..... B24D 3/18 51/293
5,785,784 A * 7/1998 Chesley et al. ..... 156/66
5,912,217 A 6/1999 Sumiya et al.
5,932,508 A 8/1999 Armstrong et al.
6,012,977 A 1/2000 Yoshikawa et al.
6,019,668 A 2/2000 Ramanath et al.
6,056,795 A 5/2000 Ramanath et al.
6,063,148 A 5/2000 Fishbacher
6,093,092 A 7/2000 Ramanath et al.
6,102,789 A 8/2000 Ramanath et al.
6,200,208 B1 3/2001 Andrews et al.
6,220,933 B1 4/2001 Shih et al.
6,485,532 B2 11/2002 Andrews et al.
6,485,533 B1 11/2002 Ishizaki et al.
6,679,758 B2 1/2004 Bright et al.
6,685,755 B2 2/2004 Ramanath et al.
6,754,827 B1 6/2004 Cane et al.
6,755,729 B2 6/2004 Ramanath et al.
6,988,937 B2 1/2006 Bonner et al.
7,007,382 B2 3/2006 Mantel
7,033,408 B2 4/2006 Fries et al.
7,074,247 B2 7/2006 Tank et al.
7,077,723 B2 7/2006 Bright et al.
7,144,307 B2 12/2006 Schwartz et al.
7,275,980 B2 10/2007 Bonner et al.
7,285,146 B2 10/2007 Petersen
7,303,461 B1 12/2007 Campomanes et al.
7,628,829 B2 12/2009 Woo et al.
7,708,619 B2 5/2010 Subramanian et al.
7,833,086 B2 11/2010 Mielke
7,896,728 B2 3/2011 Schwartz et al.
7,971,356 B2 7/2011 Orobengoa Ortubay et al.
8,377,158 B2 2/2013 Palmgren et al.
8,715,381 B2 5/2014 Ramanath et al.
9,254,553 B2 2/2016 Ramanath et al.
2001/0027623 A1* 10/2001 Rosenflanz ..... B24D 3/06 51/309
2002/0006768 A1 1/2002 Wada et al.
2002/0016139 A1 2/2002 Hirokawa et al.
2002/0066233 A1 6/2002 McArdle et al.
2002/0095871 A1 7/2002 McArdle et al.
2003/0097800 A1* 5/2003 Ramanath et al. ..... 51/309
2003/0178138 A1 9/2003 Tsukagoshi et al.
2003/0194947 A1 10/2003 Bright et al.
2003/0232586 A1 12/2003 Ramanath et al.
2005/0026553 A1 2/2005 Bonner et al.
2005/0101225 A1 5/2005 Bright et al.
2005/0129975 A1 6/2005 Ihara
2005/0257430 A1 11/2005 Fries et al.
2005/0260939 A1 11/2005 Andrews et al.
2007/0074456 A1 4/2007 Orlhac et al.
2007/0275641 A1 11/2007 Subramanian et al.
2008/0085660 A1 4/2008 Orlhac
2008/0131216 A1 6/2008 Sasu et al.
2009/0084042 A1 4/2009 Ramanath et al.
2009/0093198 A1 4/2009 Subramanian et al.
2009/0094831 A1 4/2009 Schwartz et al.
2009/0104854 A1 4/2009 Junker
2009/0151267 A1 6/2009 Upadhyay et al.
2009/0156104 A1 6/2009 Kim et al.
2010/0000158 A1 1/2010 De Leeuw-Morrison et al.
2010/0000159 A1* 1/2010 Walia et al. ..... 51/296
2010/0159806 A1 6/2010 Wu et al.
2010/0190424 A1 7/2010 Francois et al.
2010/0196700 A1 8/2010 Orlhac et al.
2010/0319269 A1 12/2010 Erickson
2011/0143641 A1* 6/2011 Ramanath et al. ..... 451/548
2011/0179646 A1 7/2011 Barnat
2011/0284841 A1 11/2011 Kondou
2011/0306276 A1 12/2011 Gagliardi
2012/0040589 A1 2/2012 Upadhyay et al.
2012/0055098 A1 3/2012 Ramanath et al.
2012/0066982 A1 3/2012 Ramanath et al.
2012/0192499 A1 8/2012 Sung
2013/0000211 A1 1/2013 Upadhyay et al.
2013/0174494 A1 7/2013 Twersky et al.
2013/0219800 A1 8/2013 Guiselin
2014/0057534 A1 2/2014 Hajduk et al.
2014/0187123 A1 7/2014 Ramanath et al.
2014/0187124 A1 7/2014 Ramanath et al.
2014/0187125 A1 7/2014 Ramanath et al.

FOREIGN PATENT DOCUMENTS

EP 174546 A2 8/1985
EP 198653 A1 10/1986
EP 1144160 A1 10/2001
EP 2445982 A2 5/2012
GB 485565 A 5/1938
GB 516475 A 1/1940
GB 1148596 A 4/1969
GB 1598837 A 9/1981
JP 51140289 A 12/1976
JP S59-035066 A 2/1984
JP 59182064 A 10/1984
JP S61-270074 A 11/1986
JP S61-270285 A 11/1986
JP S61-293769 A 12/1986
JP S62-28176 A 2/1987
JP S62-057871 A 3/1987
JP 63256364 A 10/1988
JP H02-015977 A 1/1990
JP 2088176 A 3/1990
JP 3161273 A 7/1991
JP 3190670 A 8/1991
JP 3264263 A 11/1991
JP 3281174 A 12/1991
JP H06-344264 A 12/1994
JP H07-1339 A 1/1995
JP 07-211723 A 8/1995
JP H08-133839 A 5/1996
JP H08-206962 A 8/1996
JP 10094967 A 4/1998
JP 11-320354 A 11/1999
JP 2000-317843 A 11/2000
JP 2000-326236 A 11/2000
JP 2001-062601 A 3/2001
JP 2001-246560 A 9/2001
JP 2002-273661 A 9/2002
JP 2002-534281 A 10/2002
JP 2000-516156 A 12/2002
JP 2002-370172 A 12/2002
JP 2003-181765 A 7/2003
JP 2004-291218 A 10/2004
JP 2005-342836 A 12/2005

(56) References Cited

FOREIGN PATENT DOCUMENTS

| | | | |
|---|---|---|---|
| JP | 2006-082187 | A | 3/2006 |
| JP | 2006-346824 | A | 12/2006 |
| SU | 1227441 | A1 | 4/1986 |
| WO | 98/24593 | A1 | 6/1998 |
| WO | 99/48646 | A1 | 9/1999 |
| WO | 03/045634 | A1 | 6/2003 |
| WO | 03/086704 | A1 | 10/2003 |
| WO | 2006/008258 | A1 | 1/2006 |
| WO | 2012/031229 | A2 | 3/2012 |
| WO | 2012031251 | A2 | 3/2012 |
| WO | 2014/106156 | A1 | 7/2014 |
| WO | 2014/106157 | A1 | 7/2014 |
| WO | 2014/106159 | A1 | 7/2014 |
| WO | 2014/165447 | A1 | 10/2014 |

OTHER PUBLICATIONS

International Search Report from PCT/US2013/078227 dated Apr. 23, 2014, 1 page.
International Search Report from PCT/US2013/078231 dated Apr. 24, 2014, 1 page.
International Search Report from PCT/US2014/032384 dated Jul. 15, 2014, 1 page.
PCT/US2011/050412 ISR WO, dated Apr. 10, 2012.
PCT/US2011/050384 ISR WO, dated Apr. 10, 2012.
Dai et al, "Experimental Study on Porous Metal Bonded Diamond Grinding Wheels (III)—Grinding Performance of Porous Wheels", Key Engineering Materials, 359-60, 48-52, 2008.
Matsumaru et al, "Fabrication of Porous Metal Bonded Diamond Grinding Wheels for Flat-Surface Nonomachining", MRS Bulletin, 26, 7, 544-6, 2001.
Truong et al, "Study on the Toughening of Bond Bridge of Ni—Cu—Sn Alloy—Development of Porous Meta Bonded Diamond Wheel", Seimitsu Kogaku Kaishi/Journal of the Japan Society for Precision Engineering, 0912-0289, 1998.
Tanaka, "Development of the Bridged and Pored Type of Metal Bond Diamond Wheel", Seimitsu Kogaku Kaishi/Journal of the Japan Society for Precision Engineering, 0912-0289, 1991.
Dai et al, "Effects of Alloying Additives on the Grinding Performance of Porous Wheels", Journal of Fuzhou University (Natural Science Edition), 37, 1, 80-85, 2009.
Truong et al, "Scanning Electron Microscopic Study and Mechanical Property Examination of a Bond Bridge: Development of a Porous Metal Bonded Diamond Wheel", Journal of Materials Processing Technology (Netherlands), 89-90, 385-391, 1999.
Extended European Search Report for EP Application No. EP11822738.8, dated Jun. 21, 2016, 8 pages.

* cited by examiner

BONDED ABRASIVE ARTICLE AND METHOD OF GRINDING

CROSS-REFERENCE TO RELATED APPLICATION(S)

The present application claims priority from U.S. Provisional Patent Application No. 61/806,913, filed Mar. 31, 2013, entitled "BONDED ABRASIVE ARTICLE AND METHOD OF GRINDING," naming inventors Srinivasan Ramanath, et al., and said provisional application is incorporated by reference herein in its entirety for all purposes.

BACKGROUND

Field of the Disclosure

The following is directed to bonded abrasive articles, and more particularly, bonded abrasive articles including abrasive particles contained within a bond material including a metal or metal alloy.

Description of the Related Art

Abrasives used in machining applications typically include bonded abrasive articles and coated abrasive articles. Coated abrasive articles are generally layered articles having a backing and an adhesive coat to fix abrasive particles to the backing, the most common example of which is sandpaper. Bonded abrasive tools consist of rigid, and typically monolithic, three-dimensional, abrasive composites in the form of wheels, discs, segments, mounted points, hones and other tool shapes, which may be mounted onto a machining apparatus, such as a grinding or polishing apparatus.

Bonded abrasive tools usually have at least two phases including abrasive particles and bond material. Certain bonded abrasive articles may have an additional phase in the form of porosity. Bonded abrasive tools may be manufactured in a variety of 'grades' and 'structures' that have been defined according to practice in the art by the relative hardness and density of the abrasive composite (grade) and by the volume percentage of abrasive grain, bond, and porosity within the composite (structure).

Some bonded abrasive tools may be particularly useful in grinding and shaping certain types of workpieces, including for example, metals, ceramics and crystalline materials, used in the electronics and optics industries. In other instances, certain bonded abrasive tools may be used in shaping of superabrasive materials for use in industrial applications. In the context of grinding and shaping certain workpieces with metal-bonded abrasive articles, generally the process involves a significant amount of time and labor directed to maintaining the bonded abrasive article. That is, generally, metal-bonded abrasive articles require regular truing and dressing operations to maintain the grinding capabilities of the abrasive article.

The industry continues to demand improved methods and articles capable of grinding.

SUMMARY

According to one aspect of the disclosure, an abrasive article may be configured to grind a workpiece having a fracture toughness of greater than about 5.5 $MPa \cdot m^{0.5}$. The abrasive article may include a body comprising abrasive particles contained within a bond material comprising a metal, wherein the body may comprise a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive particles may have an average particle size of at least about 1 micron and not greater than about 20 microns.

In another aspect of the disclosure, an abrasive article may be configured to grind threads on a workpiece comprising a carbide. The abrasive article may include a body comprising abrasive particles contained within a bond material comprising a metal, wherein the body may comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive particles comprise diamonds, wherein the diamonds are synthetic and wherein the diamonds are single crystal.

In another aspect of the disclosure, an abrasive article may be configured to grind threads on a workpiece comprising a carbide. The abrasive article may include a body comprising abrasive particles contained within a bond material comprising a metal and an active bond composition, wherein the body may comprise a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the active bond composition may be chemically bonded to at least a portion of a surface of the abrasive particles.

In yet another aspect of the disclosure, an abrasive article may be configured to grind threads on a workpiece comprising a carbide. The abrasive article may include a body comprising abrasive particles contained within a bond material comprising a metal, wherein the body may comprise a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the body may comprise a porosity of at least about 30 vol. % for the total volume of the body.

In still another aspect of the disclosure, an abrasive article may be configured to grind threads on a workpiece comprising a carbide. The abrasive article may include a body comprising abrasive particles contained within a bond material comprising a metal alloy of tin and copper, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the metal alloy may comprise a $C_{Sn}/C_{Cu}$ ratio of not greater than about 0.65 by weight.

In yet another aspect of the disclosure, an abrasive article may be configured to grind threads on a workpiece comprising a carbide. The abrasive article may include a body comprising abrasive particles contained within a bond material comprising a metal, wherein the body may comprise a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive article may comprise a tip radius of less than about 0.002 inches.

In still another aspect of the disclosure, an abrasive article may be configured to grind threads on a workpiece comprising a carbide. The abrasive article may include a body comprising abrasive particles contained within a bond material comprising a metal, wherein the body may comprise a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive article may produce a grinded root tip radius of less than about 0.002 inches.

In yet another aspect of the disclosure, a method of forming an abrasive article configured to grind threads on a workpiece comprising a carbide may comprise providing a mixture including abrasive particles and bond material, wherein the bond material may comprise a metal; and forming an abrasive body that may include the abrasive particles contained within the bond material, wherein the body may comprise a ratio of $V_P$:$V_{BM}$ of at least about 3:2, wherein $V_P$ is a volume percent of particulate material including abrasive particles and fillers within a total volume of the body and $V_{BM}$ is a volume percent of bond material within the total volume of the body, and wherein the abrasive article may comprise a grinding tip radius of less than about 0.002 inches.

In yet another aspect of the disclosure, a method of forming threads on a workpiece comprising a carbide may comprise moving a bonded abrasive article relative to the workpiece to form a grinded root tip radius on the workpiece of not greater than about 0.002 inches and truing and dressing the bonded abrasive article using a single tool in a single step.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1:
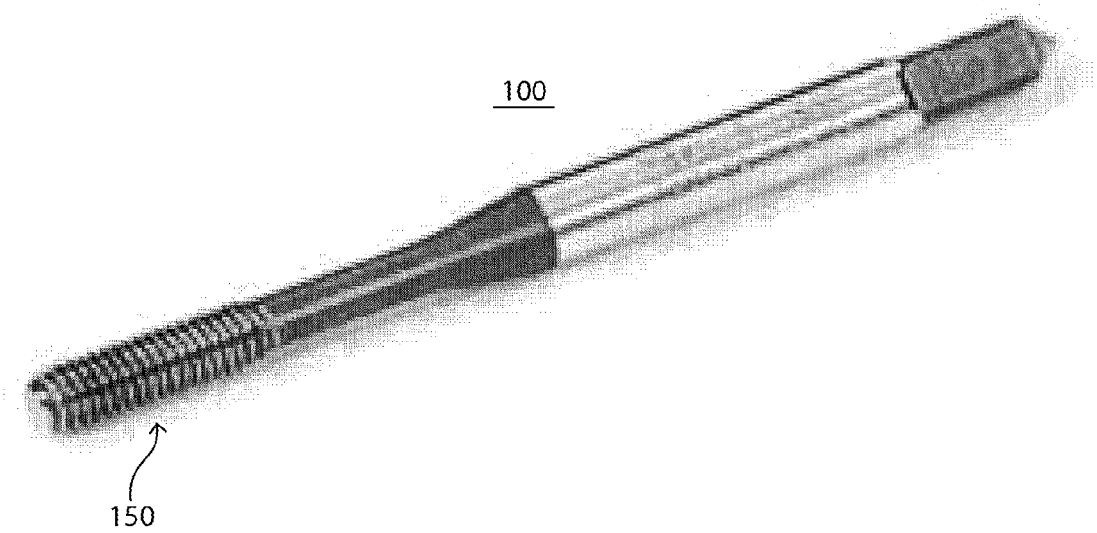
FIG. 1 includes an example of a tap workpiece with grinded threads on the workpiece.

The following is generally directed to bonded abrasive articles incorporating abrasive particles within a three-dimensional matrix of material. Bonded abrasive articles utilize a volume of abrasive particles secured within a three-dimensional matrix of bond material. Moreover, the following includes description related to methods of forming such bonded abrasive articles and applications for such bonded abrasive articles. As described in more detail below, it has been surprisingly discovered that the embodiments described herein exhibit a significant improvement in precision grinding of workpieces having a fracture toughness of greater than about 5.5 MPa $m^{0.5}$. Specifically, embodiments described herein exhibit a significant improvement in precision grinding of threads in workpieces comprising carbide.

In particular embodiments, the bonded abrasive articles described herein may be suitable for grinding certain workpieces, such as workpieces having a high fracture toughness. For example, particular embodiments of abrasive articles described herein may be configured for grinding workpieces having an average fracture toughness of greater than about 5.5 MPa·$m^{0.5}$. Examples of materials having an average fracture toughness of greater than about 5.5 MPa·$m^{0.5}$ may include carbide materials, for example, tungsten carbide.

In other particular instances, the abrasive articles may be configured to grind a workpiece having a fracture toughness of at least about 5.6 MPa·$m^{0.5}$, at least about 5.7 MPa·$m^{0.5}$, at least about 5.8 MPa·$m^{0.5}$, at least about 5.9 MPa·$m^{0.5}$, at least about 6.0 MPa·$m^{0.5}$, at least about 6.2 MPa·$m^{0.5}$, at least about 6.4 MPa·$m^{0.5}$, at least about 6.6 MPa·$m^{0.5}$ at least about 6.8 MPa·$m^{0.5}$, at least about 7.0 MPa·$m^{0.5}$, at least about 7.5 MPa·$m^{0.5}$, at least about 8.0 MPa·$m^{0.5}$, at least about 9.0 MPa·$m^{0.5}$, at least about 10.0 MPa·$m^{0.5}$, at least about 15.0 MPa·$m^{0.5}$ or even at least about 19.0 MPa·$m^{0.5}$. In other embodiments, the abrasive articles may be configured to grind a workpiece having a fracture toughness of not greater than about 20.0 MPa·$m^{0.5}$, not greater than about 15.0 MPa·$m^{0.5}$, not greater than about 10.0 MPa·$m^{0.5}$, not greater than about 9.0 MPa·$m^{0.5}$, not greater than about 8.0 MPa·$m^{0.5}$, not greater than about 7.5 MPa·$m^{0.5}$, not greater than about 7.0 MPa·$m^{0.5}$, not greater than about 6.8 MPa·$m^{0.5}$ not greater than about 6.6 MPa·$m^{0.5}$, not greater than about 6.4 MPa·$m^{0.5}$, not greater than about 6.2 MPa·$m^{0.5}$, not greater than about 6.0 MPa·$m^{0.5}$, not greater than about 5.9 MPa·$m^{0.5}$, not greater than about 5.8 MPa·$m^{0.5}$, not greater than about 5.7 MPa·$m^{0.5}$ and not greater than about 5.6 MPa·$m^{0.5}$. It will be appreciated that the abrasive articles may be configured to grind a workpiece having a fracture toughness within a range between any of the minimum and maximum values described herein. For example, the abrasive articles of embodiments herein may be configured to grind a workpiece having a fracture toughness within a range between about 5.5 MPa·$m^{0.5}$ to about 20 MPa·$m^{0.5}$ or even between about 6.0 MPa·$m^{0.5}$ to about 7.5 MPa·$m^{0.5}$.

A process for forming an abrasive article according to embodiments described herein may be initiated by forming a mixture containing abrasive particles and bond material. The abrasive particles may include a hard material. For example, the abrasive particles may have a Mohs hardness of at least about 7. In other abrasive bodies, the abrasive particles may have a Mohs hardness of at least about 8 or even at least about 9.

Abrasive articles described herein may be formed into any desired three-dimensional shape of any desired size, for example, the abrasive article may be formed into wheels, discs, segments, mounted points, hones and other tool shapes, which may be mounted onto a machining apparatus, such as a grinding or polishing apparatus.

In particular instances, the abrasive particles may be made of an inorganic material. Suitable inorganic materials may include carbides, oxides, nitrides, borides, oxycarbides, oxyborides, oxynitrides, and a combination thereof. Particular, examples of abrasive particles include silicon carbide, boron carbide, alumina, zirconia, alumina-zirconia composite particles, silicon nitride, SiAlON, and titanium boride. In certain instances, the abrasive particles may comprise a superabrasive material, such as diamond, cubic boron nitride, and a combination thereof. In particular instances, the abrasive particles may consist essentially of a superabrasive material. In other instances, the abrasive particles may consist essentially of diamond. In other instances the diamonds may be synthetic. In yet other instances, the diamonds may be single crystal.

The abrasive particles may have an average particle size of not greater than about 20 microns, not greater than about 19 microns, not greater than about 18 microns, not greater than about 17 microns, not greater than about 16 microns, not greater than about 15 microns, not greater than about 14 microns, not greater than about 13 microns, not greater than about 12 microns, not greater than about 11 microns, not greater than about 10 microns, not greater than about 9 microns, not greater than about 8 microns, not greater than about 7 microns, not greater than about 6 microns, not greater than about 5 microns, not greater than about 4 microns, not greater than about 3 microns, or even not greater than about 2 microns. In other embodiments, the abrasive particles may have an average particle size of at least about 1 micron, at least about 2 microns, at least about 3 microns, at least about 4 microns, at least about 5 microns, at least about 6 microns, at least about 7 microns, at least about 8 microns, at least about 9 microns, at least about 10 microns, at least about 11 micron, at least about 12 microns, at least about 13 microns, at least about 14 microns, at least about 15 microns, at least about 16 microns, at least about 17 microns, at least about 18 microns, or even at least about 19 microns. It will be appreciated that the abrasive particles may have an average particle size within a range between any of the average particle sizes described herein. For example, the abrasive particles of embodiments herein may have an average particle size within a range between about 1 micron to about 20 microns or even between about 5 microns to about 15 microns.

In further reference to the abrasive particles, the morphology of the abrasive particles may be described by an aspect ratio, which is a ratio between the dimensions of length to width. It will be appreciated that the length is the longest dimension of the abrasive particle and the width is the second longest dimension of a given abrasive particle. In accordance with embodiments herein, the abrasive particles may have an aspect ratio (length:width) of not greater than about 2:1 or even not greater than about 1.5:1. In particular instances, the abrasive particles may be essentially equiaxed, such that they have an aspect ratio of approximately 1:1.

The abrasive particles may include other features, including for example, a coating. The abrasive particles may be coated with a coating material which may be an inorganic material. Suitable inorganic materials may include a ceramic, a glass, a metal, a metal alloy, and a combination thereof. In particular instances, the abrasive particles may be electroplated with a metal material and, more particularly, a transition metal composition. Such coated abrasive particles may facilitate improved bonding (e.g., chemical bonding) between the abrasive particles and the bond material.

It will also be appreciated that abrasive particles of the same composition may have various mechanical properties, including for example, friability. In particular embodiments, the friability of the abrasive particles will be lower than in conventional abrasive articles. The mixture, and the finally-formed bonded abrasive body, can incorporate a mixture of abrasive particles, which may be the same composition, but having varying mechanical properties or grades. For example, the mixture may include abrasive particles of a single composition, such that the mixture includes only diamond or cubic boron nitride. However, the diamond or cubic boron nitride may include a mixture of different grades of diamond or cubic boron nitride, such that the abrasive particles having varying grades and varying mechanical properties.

The abrasive particles may be provided in the mixture in an amount such that the finally-formed abrasive article contains a particular amount of abrasive particles. In certain embodiments, the amount of abrasive particles in the finally-formed abrasive article may be at least about 30 vol. %, at least about 35 vol. %, at least about 40 vol. %, at least about 45 vol. %, at least about 50 vol. %, at least about 55 vol. %, at least about 60 vol. %, at least about 65 vol. %, at least about 70 vol. %, at least about 75 vol. % or even at least about 80 vol. % for the total volume of the abrasive article. In other embodiments, the amount of abrasive particles in the finally-formed abrasive article may be not greater than about 85 vol. %, not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. % or even not greater than about 35 vol. % for the total volume of the abrasive article. It will be appreciated that the amount of abrasive particles in the finally-formed abrasive article may be within a range between any of the minimum and maximum values described herein.

In accordance with an embodiment, the bond material may be a metal or metal alloy material. For example, the bond material may include a powder composition including at least one transition metal element. In particular instances, the bond material may include a metal selected from the group including copper, tin, silver, molybdenum, zinc, tungsten, iron, nickel, antimony, and a combination thereof.

In one particular embodiment, the bond material may comprise a metal alloy of tin and copper. The metal alloy of tin and copper may be a bronze material. The bronze material may have a particular ratio of the content of Sn in the bronze ($C_{Sn}$) to the content of Cu in the bronze ($C_{Cu}$). The ratio may be expressed mathematically as $C_{Sn}/C_{Cu}$. $C_{Sn}$ represents the content of Sn in the bronze measured as a wt. % of the total weight of the bronze. $C_{Cu}$ represents the content of Cu in the bronze measured as a wt. % of the total weight of the bronze. In one instance, the bronze alloy may have a $C_{Sn}/C_{Cu}$ ratio of not greater than about 0.65, not greater than about 0.64, not greater than about 0.63, not greater than about 0.62, not greater than about 0.61, not greater than about 0.60, not greater than about 0.59, not greater than about 0.58, not greater than about 0.57, not greater than about 0.56, not greater than about 0.55, not greater than about 0.54, not greater than about 0.53, not greater than about 0.52, not greater than about 0.51, not greater than about 0.50, not greater than about 0.49, not greater than about 0.48, not greater than about 0.47, not greater than about 0.46, not greater than about 0.45, not greater than about 0.44, not greater than about 0.43, not greater than about 0.42, not greater than about 0.41, not greater than about 0.40, not greater than about 0.39, not greater than about 0.38, not greater than about 0.37, not greater than about 0.36, not greater than about 0.35, not greater than about 0.34, not greater than about 0.33, not greater than about 0.32, not greater than about 0.31, not greater than about 0.30, not greater than about 0.28, not greater than about 0.26, not greater than about 0.24, not greater than about 0.22, not greater than about 0.20, not greater than about 0.15 or even not greater than about 0.12. In another instance, the bronze alloy may have a $C_{Sn}/C_{Cu}$ ratio of at least about 0.10, at least about 0.15, at least about 0.20, at least about 0.22, at least about 0.24, at least about 0.26, at least about 0.28, at least about 030, at least about 0.31, at least about 0.32, at least about 0.33, at least about 0.34, at least about 0.35, at least about 0.36, at least about 0.37, at least about 0.38, at least about 0.39, at least about 0.40, at least about 0.41, at least about 0.42, at least about 0.43, at least about 0.44, at least about 0.45, at least about 0.46, at least about 0.47, at least about 0.48, at least about 0.49, at least about 0.50, at least about 0.51, at least about 0.52, at least about 0.53, at least about 0.54, at least about 0.55, at least about 0.56, at least about 0.57, at least about 0.58, at least about 0.59, at least about 0.60, at least about 0.61, at least about 0.62, at least about 0.63 or even at least about 0.64. It will be appreciated that in particular instances, the bronze alloy may have a $C_{Sn}/C_{Cu}$ ratio within a range between any of the minimum and maximum values described above. For example, the bronze alloy may have a $C_{Sn}/C_{Cu}$ ratio within a range between about 0.10 to about 0.65 or even between about 0.30 to about 0.45.

According to another particular embodiment, the metal alloy of copper and tin may include a certain content of copper, such that the finally-formed bonded abrasive article has suitable mechanical characteristics and grinding performance. For example, the copper and tin metal alloy may include at least about 60 wt. % copper, at least about 65 wt. % copper, at least about 70 wt. % copper, at least about 75 wt. % copper, at least about 80 wt. % copper, at least about 85 wt. % copper, at least about 90 wt. % copper or even at least about 95 wt. % copper for the total weight of the metal alloy. In another embodiment, the copper and tin metal alloy may include not greater than about 99 wt. % copper, not greater than about 95 wt. % copper, not greater than about 90 wt. % copper, not greater than about 85 wt. % copper, not greater than about 80 wt. % copper, not greater than about 75 wt. % copper, not greater than about 70 wt. % copper or even not greater than about 65 wt. % for the total weight of the metal alloy. It will be appreciated that amount of copper in the copper tin metal alloy may be within a range of any of the minimum and maximum values described herein. In particular instances, the amount of copper is within a range between about 60 wt. % and about 95 wt. %, and more particularly, between about 70 wt. % and about 85 wt. % for the total weight of the metal alloy.

According to another embodiment, certain metal alloys of copper and tin may have a certain content of tin. For example, the metal alloy may include at least about 5 wt. % tin of the total weight of the composition. In other instances, the content of tin may be greater, such as, at least about 10 wt. %, at least about 15 wt. %, at least about 20 wt. %, at least about 25 wt. %, at least about 30 wt. %, at least about 35 wt. % or even at least about 40 wt. % for the total weight of the metal alloy. In other embodiments, the amount of tin may be not greater than about 45 wt. %, not greater than about 40 wt. %, not greater than about 35 wt. %, not greater than about 30 wt. %, not greater than about 25 wt. %, not greater than about 20 wt. %, not greater than about 15 wt. % or even not greater than about 10 wt. %. It will be appreciated that the content of tin in the metal alloy of copper and tin may be within a range of any of the minimum and maximum values described herein. In particular, certain bond materials may include a copper and tin metal alloy having a content of tin within a range between about 5 wt. % and about 40 wt. %, between about 10 wt. % and about 35 wt. %, or even between about 20 wt. % and about 25 wt. %.

In addition to the abrasive particles and bond material, the mixture may further include an active bond precursor composition. The active bond precursor composition may include a material that facilitates chemical reaction between certain components of the bonded abrasive body, including for example, particulate material (e.g., abrasive particles and/or fillers) and bond material. The active bond precursor composition may be added to the mixture in minor amounts, and particularly, in amounts less than the amount of the abrasive particles present within the mixture.

In accordance with an embodiment, the active bond precursor composition may comprise a metal or metal alloy. More particularly, the active bond precursor composition may comprise a composition or complex including hydrogen. For example, the active bond precursor composition may comprise a metal hydride, and more particularly, may comprise a material such as titanium hydride. In one embodiment, the active bond precursor composition consists essentially of titanium hydride.

The mixture generally includes a minor amount of the active bond precursor composition. For example, the mixture may include not greater than about 40 wt. % of the active bond precursor composition precursor of the total weight of the mixture. In other embodiments, the amount of the active bond precursor composition within the mixture may be less, such as not greater than about 35 wt. %, not greater than about 30 wt. %, not greater than about 28 wt. %, not greater than about 26 wt. %, not greater than about 23 wt. %, not greater than about 18 wt. %, not greater than about 15 wt. %, not greater than about 12 wt. %, not greater than about 10 wt. %, not greater than about 8 wt. %, not greater than about 6 wt. % or even not greater than about 4 wt. % for the total weight of the mixture. In other embodiments, the amount of the active bond precursor composition within the mixture may be at least about 2 wt. %, at least about 4 wt. %, at least about 6 wt. %, at least about 8 wt. %, at least about 10 wt. %, at least about 15 wt. %, at least about 19 wt. %, at least about 23 wt. %, at least about 26 wt. %, at least about 28 wt. % or ever at least about 30 wt. % for the total weight of the mixture. It will be appreciated that the amount of active bond precursor composition within the mixture may be within a range between any of the minimum and maximum values described herein. In particular instances, the amount of active bond precursor composition within the mixture may be within a range between about 2 wt. % to about 40 wt. %, between about 4 wt. % to about 35 wt. %, between about 8 wt. % to about 28 wt. %, between about 10 wt. % to about 28 wt. % or even between about 12 wt. % to about 26 wt. % for the total weight of the mixture.

The mixture may further include a binder material. The binder material may be utilized to provide suitable strength during formation of the bonded abrasive article. Certain suitable binder materials may include an organic material. For example, the organic material may be a material such as a thermoset, thermoplastic, adhesive and a combination thereof. In one particular instance, the organic material of the binder material includes a material such as polyimides, polyamides, resins, aramids, epoxies, polyesters, polyurethanes, acetates, celluloses, and a combination thereof. In one embodiment, the mixture may include a binder material utilizing a combination of a thermoplastic material configured to cure at a particular temperature. In another embodiment, the binder material may include an adhesive material suitable for facilitating attachment between components of the mixture. The binder may be in the form of a liquid, including for example, an aqueous-based or non-aqueous-based compound.

Generally, the binder material may be present in a minor amount (by weight) within the mixture. For example, the binder may be present in an amount significantly less than the amount of the abrasive particles, bond material, or the active bond precursor composition. For example, the mixture may include not greater than about 40 wt. % of binder material for the total weight of the mixture. In other embodiments, the amount of binder material within the mixture may be less, such as not greater than about 35 wt. %, not greater than about 30 wt. %, not greater than about 28 wt. %, not greater than about 26 wt. %, not greater than about 23 wt. %, not greater than about 18 wt. %, not greater than about 15 wt. %, not greater than about 12 wt. %, or even not greater than about 10 wt. % for the total weight of the mixture. In other particular instances, the amount of binder material within the mixture may be at least about 2 wt. %, at least about 4 wt. %, at least about 8 wt. %, at least about 10 wt. %, at least about 12 wt. %, at least about 15 wt. %, at least about 18 wt. %, at least about 23 wt. %, at least about 26 wt. %, at least about 28 wt. % or even at least about 30 wt. % for the total weight of the mixture. It will be appreciated that the amount of binder present within the mixture may be within a range between any of the minimum and maximum values described herein. In other particular instances, the amount of binder material within the mixture may be within a range between about 2 wt. % and about 40 wt. %, such as between about 4 wt. % and about 35 wt. %, between about 8 wt. % and about 28 wt. %, between about 10 wt. % and about 28 wt. %, or even between about 12 wt. % and about 26 wt. % for the total weight of the mixture.

The mixture may further include a certain amount of fillers. The fillers may be a particulate material, which may be substituted for certain components within the mixture, including for example, the abrasive particles. Notably, the fillers may be a particulate material that may be incorporated in the mixture, wherein the fillers substantially maintain their original size and shape in the finally-formed bonded abrasive body. The fillers may be natural or synthetic materials. Examples of suitable fillers may include oxides, carbides, borides, silicides, nitrides, oxynitrides, oxycarbides, silicates, graphite, silicon, inter-metallics, ceramics, hollow-ceramics, fused silica, glass, glass-ceramics, hollow glass spheres, natural materials such as shells, and a combination thereof.

Notably, certain fillers may have a hardness that is less than the hardness of the abrasive particles. Additionally, the mixture may be formed such that the fillers are present in an amount of not greater than about 90 vol. % of the total volume of the mixture. Volume percent is used to describe the content of fillers as fillers may have varying density depending upon the type of particulate, such as hollow spheres versus heavy particulate. In other embodiments, the amount of filler within the mixture may be not greater than about 80 vol. %, such as not greater than about 70 vol. %, not greater than about 60 vol. %, not greater than about 50 vol. %, not greater than about 40 vol. %, not greater than about 30 vol. % or even not greater than about 20 vol. % for the total volume of the mixture. In other embodiments, the amount of filler within the mixture may be at least about 15 vol. %, such as at least about 20 vol. %, at least about 30 vol. %, at least about 40 vol. %, at least about 50 vol. %, at least about 60 vol. % or even at least about 70 vol. % for the total volume of the mixture. It will be appreciated that the amount of filler present within the mixture may be within a range between any of the minimum and maximum values described herein.

Certain forming processes may utilize a greater amount of filler material than the amount of abrasive particles. For example, nearly all of the abrasive particles may be substituted with one or more filler materials. In other instances, a majority content of the abrasive particles may be substituted with filler material. In other embodiments, a minor portion of the abrasive particles may be substituted with filler material.

Moreover, the fillers may have an average particulate size that is significantly less than the average particle size of the abrasive particles. In certain embodiments, the average particulate size of the fillers may be at least about 5% less, such as at least about 10% less, such as at least about 15% less, at least about 20% less, or even at least about 25% less than the average particle size of the abrasive particles based on the average particle size of the average particle size of the abrasive particles. In other embodiments, the average particulate size of the fillers may be not greater than about 30% less, such as not greater than about 25% less, such as not greater than about 20% less, not greater than about 15% less, or even not greater than about 10% less than the average particle size of the abrasive particles based on the average particle size of the average particle size of the abrasive particles. It will be appreciated that the average particle size of the fillers present in the mixture may be lees than the average particle size of the abrasive particles by any value within a range between any of the minimum and maximum values described herein.

In certain other embodiments, the fillers may have an average particulate size that is greater than the abrasive particles, particularly in the context of fillers that are hollow bodies.

In particular instances, the filler material may have a fracture toughness ($K_{1c}$) of not greater than about 10 MPa $m^{0.5}$, as measured by a nano-indentation test via standardized test of ISO 14577 utilizing a diamond probe available from CSM Indentation Testers, Inc., Switzerland or similar companies. In other embodiments, the filler may have a fracture toughness ($K_{1c}$) of not greater than about 9 MPa $m^{0.5}$, such as not greater than about 8 MPa $m^{0.5}$, or even not greater than about 7 MPa $m^{0.5}$. In other embodiments, the filler may have a fracture toughness ($K_{1c}$) of at least about 0.5 MPa $m^{0.5}$, such as at least about 1 MPa $m^{0.5}$ or even at least about 2 MPa $m^{0.5}$. It will be appreciated that the filler may have a fracture toughness of any value within a range between any of the minimum and maximum values described herein. In particular embodiments, the average fracture toughness of the fillers may be within a range between about 0.5 MPa $m^{0.5}$ and about 10 MPa $m^{0.5}$, such as within a range between about 1 MPa $m^{0.5}$ and about 9 MPa $m^{0.5}$, or even within a range between about 2 MPa $m^{0.5}$ and about 7 MPa $m^{0.5}$.

After forming the mixture, the process of forming the bonded abrasive article continues by shearing the mixture such that it has proper rheological characteristics. For example, the mixture may be sheared until it has a particular viscosity, and may have a consistency that is semi-liquid (e.g., a mud-like consistency). In other instances, it could be of much lower viscosity such as a paste.

After shearing the mixture, the process can continue by forming agglomerates from the mixture. Process of forming agglomerates can initially include a process of drying the mixture. In particular the drying process may be conducted at a temperature suitable to cure an organic component (e.g., thermoset) within the binder contained within the mixture, and remove a portion of certain volatiles (e.g., moisture) within the mixture. Thus, upon suitable curing the organic material within the binder material, the mixture may have a hardened or semi-hardened form. Particularly suitable drying temperatures may be not greater than about 100° C., and more particularly, within a range between about 0° C. and about 100° C.

After drying the mixture at a suitable temperature, the process of forming agglomerates can continue by crushing the hardened form. After crushing the hardened form, the crushed particles include agglomerates of the components contained within the mixture, including the abrasive particles and bond material. The process of forming the agglomerates can then include sieving of the crushed particulate to obtain a suitable distribution of agglomerate sizes.

After forming the agglomerates, the process can continue by shaping the agglomerates into a desirable shape of the finally-formed bonded abrasive article. One suitable shaping process includes filling a mold with the agglomerated particles. After filling the mold, the agglomerates may be pressed to form a green (i.e., unsintered) body having the dimensions of the mold. In accordance with one embodiment, pressing may be conducted at a pressure of at least about 0.01 ton/in$^2$ of the area of the bonded abrasive article. In other embodiments, the pressure may be greater, such as on the order of at least about 0.1 tons/in$^2$, at least about 0.5 tons/in$^2$, at least about 1 ton/in$^2$, or even at least about 2 tons/in$^2$. In one particular embodiment pressing is completed at a pressure within a range between about 0.01 ton/in$^2$ and about 10 tons/in$^2$, or more particularly, within a range between about 0.5 tons/in$^2$ and about 3 tons/in$^2$.

After shaping the mixture to form the green article, the process can continue by treating the green article. Treating may include heat treating the green article, and particularly sintering of the green article. In one particular embodiment, treating includes liquid phase sintering to form the bonded abrasive body. Notably, liquid phase sintering includes forming a liquid phase of certain components of the green article, particularly, the bond material, such that at the sintering temperature at least a portion of the bond material is present in liquid phase and free-flowing. Notably, liquid phase sintering is not a process generally used for formation of bonded abrasives utilizing a metal bond material.

In accordance with an embodiment, treating the green article includes heating the green article to a liquid phase sintering temperature of at least 400° C. In other embodiments, the liquid phase sintering temperature may be greater, such as at least 500° C., at least about 650° C., at least about 800° C., or even at least about 900° C. In particular instances, the liquid phase sintering temperature may be within a range between about 400° C. and about 1100° C., such as between about 800° C., and about 1100° C., and more particularly, within a range between about 800° C. and 1050° C.

Treating, and particularly sintering, may be conducted for a particular duration. Sintering at the liquid phase sintering temperature may be conducted for a duration of at least about 10 minutes, at least about 20 minutes, at least about 30 minutes, or even at least about 40 minutes. In particular embodiments, the sintering at the liquid phase sintering temperature can last for a duration within a range between about 10 minutes and about 90 minutes, such as between about 10 minutes and 60 minutes, or even between about 15 minutes and about 45 minutes.

Treating the green article may further include conducting a liquid phase sintering process in a particular atmosphere. For example, the atmosphere may be a reduced pressure atmosphere having a pressure of not greater than about $10^{-2}$ TOM In other embodiments, the reduce pressure atmosphere may have a pressure of not greater than about $10^{-3}$ Ton, not greater than about $10^{-4}$ Ton, such as not greater than about $10^{-5}$ Ton, or even not greater than about $10^{-6}$ Torr. In particular instances, the reduced pressure atmosphere may be within a range between about $10^{-2}$ Torr and about $10^{-6}$ Torr.

Additionally, during treating the green article, and particularly during a liquid phase sintering process, the atmosphere may be a non-oxidizing (i.e., reducing) atmosphere. Suitable gaseous species for forming the reducing atmosphere may include hydrogen, nitrogen, noble gases, carbon monoxide, dissociated ammonia, and a combination thereof. In other embodiments, an inert atmosphere may be used during treating of the green article, to limit oxidation of the metal and metal alloy components.

After completing the treating process, a bonded abrasive article incorporating abrasive particles within a metal bond material is formed. In accordance with an embodiment, the abrasive article may have a body having particular features. For example, in accordance with one embodiment, the bonded abrasive body may have a significantly greater volume of abrasive particles than the volume of bond material within the body. The bonded abrasive body may have a ratio of $V_{AG}/V_{BM}$ of at least about 1.3, wherein $V_{AG}$ represents a volume percent of abrasive particles within the total volume of the bonded abrasive body, and $V_{BM}$ represents the volume percent of bond material within the total volume of the bonded abrasive body. In accordance with another embodiment, the ratio of $V_{AG}/V_{BM}$ may be at least about 1.5, such as at least about 1.7, at least about 2.0, at least about 2.1, at least about 2.2 or even at least about 2.5. In accordance with another embodiment, the ratio of $V_{AG}/V_{BM}$ may be not greater than about 9.0, not greater than about 8.0, not greater than about 7.0, not greater than about 6.0 or even not greater than about 5.0. It will be appreciate that the ratio $V_{AG}/V_{BM}$ may be within a range between any of the minimum and maximum values described herein. In other embodiments, the bonded abrasive body may be formed such that the ratio of $V_{AG}/V_{BM}$ is within a range between about 1.3 and about 9.0, such as between about 1.3 and about 8.0, such as between about 1.5 and about 7.0, such as between about 1.5 and about 6.0, between about 2.0 and about 5.0, between about 2.0 and about 4.0, between about 2.1 and about 3.8, or even between about 2.2 and about 3.5.

Figure 2:
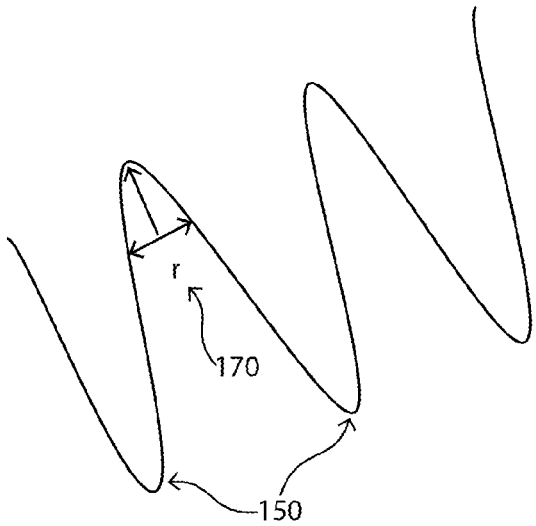
FIG. 2 includes an illustration of a profile of a portion of the grinded threads of the workpiece shown in FIG. 1.

It should be appreciated that abrasive articles formed according to embodiments described herein may be particularly well suited for grinding precise threads into workpieces, for example, workpieces comprising carbide. A precise thread may be, for example, a thread having a set grinded root radius of the thread. FIG. 1 illustrates an example of a tap workpiece 100 having threads 150 grinded on the workpiece. FIG. 2 illustrates the profile of a portion of the threads 150 of the tap workpiece 100 with a root 170 between the threads 150. The root 170 may have a grinded root radius of r.

In particular embodiments, abrasive articles described herein may be configured to provide a grinded root radius between threads on a workpiece of not greater than about 0.002 inches, not greater than about 0.0019 inches, not greater than about 0.0015 inches, not greater than about 0.0010 inches or even, not greater than about 0.0005 inches. In other embodiments, abrasive articles described herein may be configured to provide a grinded foot radius of at least about 0.0005 inches, at least about 0.0010 inches, at least about 0.0015 inches or even at least about 0.0019 inches. It will be appreciated that an abrasive article described herein may be configured to provide a grinded root radius within a range between any of the minimum and maximum values described herein. For example, in a particular embodiment, abrasive articles may be configured to provide a grinded root radius between threads on a workpiece within a range between about 0.0005 inches to about 0.002 inches or even between about 0.001 inches to about 0.0015 inches.

In order to grind precise threads into workpieces, abrasive articles of embodiments described herein may comprise a tip radius of not greater than the grinded root radius that the abrasive article may be configured to grind between threads on the workpiece. The tip radius of the abrasive article may be the radius of the grinding tip or surface of the body of the abrasive article that comes in contact with the workpiece. In particular embodiments, the abrasive article may comprise a tip radius of not greater than 0.002 inches, not greater than about 0.0019 inches, not greater than about 0.0015 inches, not greater than about 0.0010 inches or even, not greater than about 0.0005 inches. In other embodiments, the abrasive article may comprise a tip radius of at least about 0.0005 inches, at least about 0.0010 inches, at least about 0.0015 inches or even at least about 0.0019 inches. It will be appreciated that the abrasive article may comprise a tip radius within a range between any of the minimum and maximum values described herein. For example, abrasive articles of embodiments described herein may comprise a tip radius within a range between about 0.0005 inches to about 0.002 inches or even between about 0.001 inches to about 0.0015 inches.

In other embodiments, the bonded abrasive body may include at least about 30 vol. % abrasive particles for the total volume of the bonded abrasive body. In other instances, the content of abrasive particles is greater, such as at least about 45 vol. %, at least about 50 vol. %, at least about 60 vol. %, at least about 70 vol. %, or even at least about 75 vol. % for the total volume of the boned abrasive body. In other instances, the content of abrasive particles may be not greater than about 90 vol. %, not greater than about 85 vol. %, not greater than about 80 vol. %, not greater than about 75 vol. %, or even not greater than about 70 vol. % for the total volume of the bonded abrasive body. It will be appreciated that the bonded abrasive body may include any content of abrasive particles within a range between any of the minimum and maximum values described herein. In particular embodiments, the bonded abrasive body comprises between about 30 vol. % and about 90 vol. %, such as between about 45 vol. % and about 90 vol. %, between about 50 vol. % and about 85 vol. %, or even between about 60 vol. % and about 80 vol. % abrasive particles for the total volume of the bonded abrasive body.

In other embodiments, the bonded abrasive body may include not greater than about 45 vol. % bond material for the total volume of the bonded abrasive body. According to certain embodiments, the content of bond material is less, such as, not greater than about 40 vol. %, not greater than about 30 vol. %, not greater than about 25 vol. %, not greater than about 20 vol. %, or even not greater than about 15 vol. %. In particular embodiments, the bonded abrasive body comprises between about 5 vol. % and about 45 vol. %, such as, between about 5 vol. % and about 40 vol. %, between about 5 vol. % and about 30 vol. %, or even between about 10 vol. % and about 30 vol. % bond material for the total volume of the bonded abrasive body.

In accordance with another embodiment, the bonded abrasive body herein may include a certain amount of porosity. For example, the bonded abrasive body may have at least about 30 vol. % porosity for the total volume of the bonded abrasive body. In other embodiments, the bonded abrasive body may have at least about 35 vol. %, such as at least about 40 vol. %, at least about 45 vol. %, at least about 50 vol. %, at least about 55 vol. %, at least about 60 vol. %, at least about 65 vol. %, at least about 70 vol. % or even at least about 75 vol. % porosity for the total volume of the body. Still, in other embodiments, the bonded abrasive body may include not greater than about 80 vol. % porosity for the total volume of the body. In other articles, the bonded abrasive body may have not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. % or even not greater than about 35 vol. % porosity for the total volume of the body. It will be appreciated that the vol. % porosity for the total volume of the body may be within a range between any of the minimum and maximum values described herein.

The bonded abrasive body may be formed such that a certain content of the porosity within the bonded abrasive body is interconnected porosity. Interconnected porosity defines a network of interconnected channels (i.e., pores) extending through the volume of the bonded abrasive body. For example, a majority of the porosity of the body may be interconnected porosity. In fact, in particular instances, the bonded abrasive body may be formed such that at least 60%, at least about 70%, at least about 80%, at least about 90%, or even at least about 95% of the porosity present within the bonded abrasive body is interconnected porosity. In certain instances, essentially all of the porosity present within the body is interconnected porosity. Accordingly, the bonded abrasive body may be defined by a continuous network of two phases, a solid phase defined by the bond and abrasive particles and a second continuous phase defined by the porosity extending between the solid phase throughout the bonded abrasive body.

In accordance with another embodiment, the bonded abrasive body may have a particular ratio of particulate material ($V_P$), which includes abrasive particles and fillers, as compared to the bond material ($V_{BM}$) for the total volume of the bonded abrasive body. It will be appreciated that the amounts of the particulate material and the bond material are measured in volume percent of the component as part of the total volume of the body. In one particular embodiment, the bonded abrasive body may have a ratio ($V_P/V_{BM}$) of at least about 1.5. In other embodiments, the ratio ($V_P/V_{BM}$) may be at least about 1.7, at least about 2.0, at least about 2.2, at least about 2.5, or even at least about 2.8. In another particular embodiment, the bonded abrasive body may have a ratio ($V_P/V_{BM}$) of not greater than about 9.0, not greater than about 8.0, not greater than about 7.0 or even not greater than about 6.0. It will be appreciated that the ratio ($V_P/V_{BM}$) may be any value within a range between the minimum and maximum values described herein. In particular instances, the ratio ($V_P/V_{BM}$) may be within a range between 1.5 and about 9.0, such as between about 1.5 and 8.0, such as between about 1.5 and about 7.0, between about 1.7 and about 7.0, between about 1.7 and about 6.0, between about 1.7 and about 5.5, or even between about 2.0 and about 5.5. As such, the bonded abrasive body can incorporate a higher content of particulate material including fillers and abrasive particles than bond material.

According to one embodiment, the abrasive body may include an amount (vol. %) of fillers that may be less than, equal to, or even greater than the amount (vol. %) of abrasive particles present within the total volume of the bonded abrasive body. Certain abrasive articles can utilize not greater than about 75 vol. % fillers for the total volume of the bonded abrasive body. According to certain embodiments, the content of fillers in the body may be not greater than about 50 vol. %, not greater than about 40 vol. %, not greater than about 30 vol. %, not greater than about 25 vol. %, not greater than about 20 vol. %, not greater than about 15 vol. %, not greater than about 10 vol. % or even not greater than about 5 vol. % for the total volume of the body. According to other embodiments, the content of fillers in the body may be at least 1 vol. %, at least about 2 vol. %, at least about 5 vol. %, at least about 10 vol. %, at least about 15 vol. %, at least about 20 vol. % or even at least about 25 vol. % for the total volume of the body. It will be appreciated that the content of fillers in the body may be within a range between any of the minimum an maximum values described herein. In particular embodiments, the bonded abrasive body comprises between about 1 vol. % and about 75 vol. %, such as between about 2 vol. % and about 50 vol. %, between about 5 vol. % and about 20 vol. %, or even between about 10 vol. % and about 15 vol. % fillers for the total volume of the bonded abrasive body. In one instance, the bonded abrasive body may be essentially free of fillers. In another embodiment, the fillers may be present in an amount less than an amount of the abrasive particles as measure by volume percent of the total volume of the body.

The bonded abrasive bodies of embodiments herein may have a particular content of active bond composition. As will be appreciated, the active bond composition may be a reaction product formed from a reaction between the active bond composition precursor and certain components of the bonded abrasive body, including for example, abrasive particles, fillers, and bond material. The active bond composition can facilitate chemical bonding between the particulates (e.g., abrasive particles or filler) within the body and the bond material, which may facilitate retention of particulates within the bond material.

The active bond composition may include a material that facilitates chemical reaction between certain components of the bonded abrasive body, including for example, particulate material (e.g., abrasive particles and/or fillers) and bond material. In accordance with an embodiment, the active bond composition may comprise a metal or metal alloy. More particularly, the active bond composition may comprise a composition or complex including hydrogen. For example, the active bond composition may comprise a metal hydride, and more particularly, may comprise a material such as titanium hydride. In one embodiment, the active bond composition consists essentially of titanium hydride.

In particular, the active bond composition may be distinct from the bond material. In another particular embodiment, the active bond composition may include distinct phases, which may be disposed in distinct regions of the bonded abrasive body. Moreover, the active bond composition may have a particular composition depending upon the location of the composition. For example, the active bond composition may include a precipitated phase and an interfacial phase. The precipitated phase may be present within the bond material and may be dispersed as a distinct phase throughout the volume of the bond material. The interfacial phase may be disposed at the interface between the particulate material (i.e., abrasive particles and/or fillers) and the bond material. The active bond composition may surround at least a portion of the particulate material in the body, for example the abrasive particles. The active bond composition may surround a majority of the particulate material in the body, for example, the abrasive particles. The interfacial phase can extend around a majority of the surface area of the particulate material of the body, for example, the abrasive particles.

Accordingly, the bond material may be a composite material including a bond phase and a precipitate phase, which are separate phases. The precipitated phase may be made of a composition including at least one element of the active bond composition and at least one element of the bond material. Notably, the precipitated phase may include at least one metal element originally provided in the mixture as the bond material. The precipitated phase may be a metal or metal alloy compound or complex. In particular embodiments, the precipitated phase may include a material selected from the group of materials consisting of titanium, vanadium, chromium, zirconium, hafnium, tungsten, and a combination thereof. In more particular instances, the precipitated phase includes titanium, and may consist essentially of titanium and tin.

The bond phase of the bond material may include a transition metal element, and particularly a metal element included in the original bond material used to form the mixture. As such, the bond phase may be formed of a material selected from the group of metals consisting of copper, tin, silver, molybdenum, zinc, tungsten, iron, nickel, antimony, and a combination thereof. In particular instances, the bond phase may include copper, and may be a copper-based compound or complex. In certain embodiments, the bond phase consists essentially of copper.

The interfacial phase may include at least one element of the active bond composition. Moreover, the interfacial phase may include at least one element of the particulate material. As such, the interfacial phase may be a compound or complex formed through a chemical reaction between the active bond composition and the particulate. Certain interfacial phase materials include carbides, oxides, nitrides, borides, oxynitrides, oxyborides, oxycarbides and a combination thereof. The interfacial phase may include a metal, and more particularly, may be a compound incorporating a metal, such as a metal carbide, metal nitride, metal oxide, metal oxynitride, metal oxyboride, or metal oxycarbide. According to one embodiment, the interfacial phase consists essentially of a material from the group of titanium carbide, titanium nitride, titanium boronitride, titanium aluminum oxide, and a combination thereof.

Moreover, the interfacial phase may have an average thickness of at least about 0.1 microns. However, and more particularly, the interfacial phase may have a varying thickness depending upon the size of the particulate material the interfacial phase overlies. For example, with regard to abrasive particles and/or fillers having an average size of less than 10 microns, the interfacial phase may have a thickness within a range between about 1% to 205 of the average size of the particulate. For particulate material having an average size within a range between about 10 microns and about 50 microns, the interfacial phase may have a thickness within a range between about 1% to about 10% of the average size of the particulate. For particulate material having an average size within a range between about 50 microns and about 500 microns, the interfacial phase may have a thickness within a range between about 0.5% to about 10% of the average size of the particulate. For particulate material having an average size of greater than about 500 microns, the interfacial phase may have a thickness within a range between about 0.1% to about 0.5% of the average size of the particulate.

FIGS. 3-6 include magnified images of the microstructure of a bonded abrasive body in accordance with an embodiment.

Figure 3:
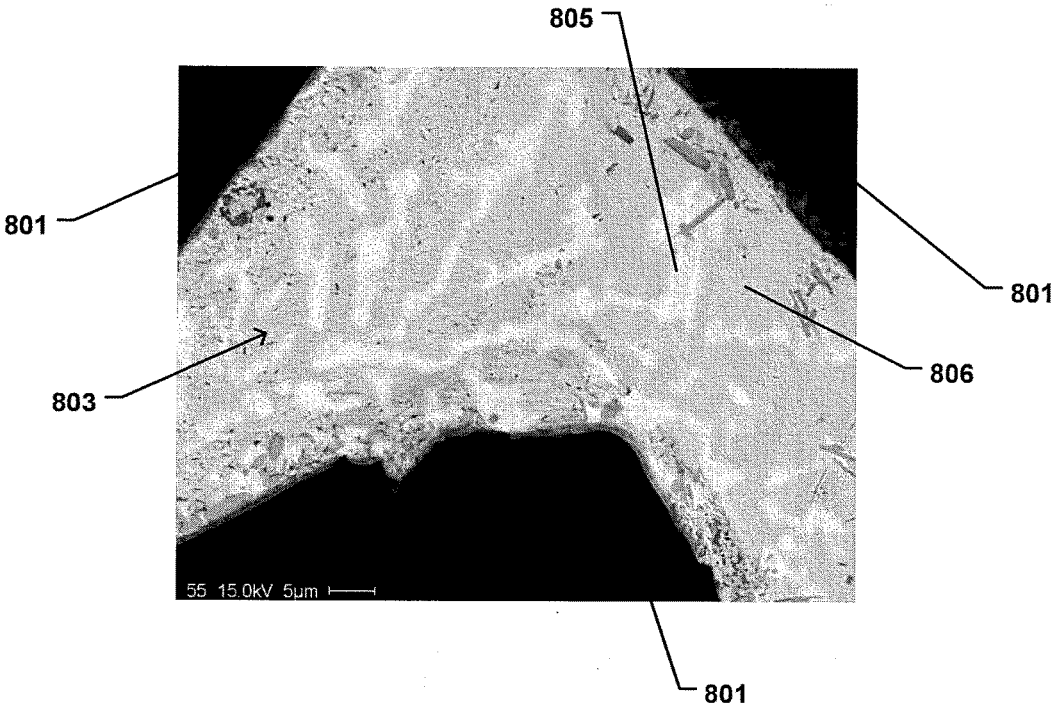
FIGS. 3-6 include magnified images of the microstructure of a bonded abrasive body according to an embodiment.

FIG. 3 includes a scanning electron microscope image (operated in backscatter mode) of a cross-section of a portion of a bonded abrasive body including abrasive particles 801 and bond material 803 extending between the abrasive particles 801. As illustrated, the bond material 803 includes two distinct phases of material, a precipitated phase 805 represented by a lighter color and extending through the volume of the bond material 803, and a bond phase 806 represented by a darker color and extending through the volume of the bond material 803.

FIGS. 4-11 include magnified images of the same area of the bonded abrasive body of FIG. 3, using microprobe analysis to identify select elements present in certain regions of the body.

Figure 4:
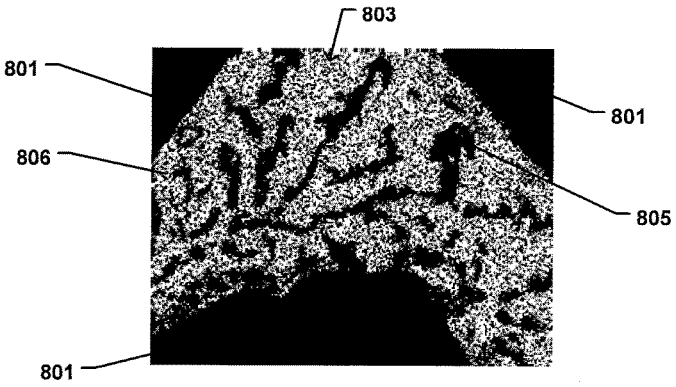

FIG. 4 includes a microprobe image of the region of FIG. 3 in a mode set to identify regions high in copper, such that the lighter regions indicate regions where copper is present.

According to an embodiment, the bond material 803 may include a metal alloy of copper and tin. According to a more particular embodiment, the bond phase 806 of the bond material 803, which is one of at least two distinct phases of the bond material 803, may have a greater amount of copper present than the precipitated phase 805.

Figure 5:
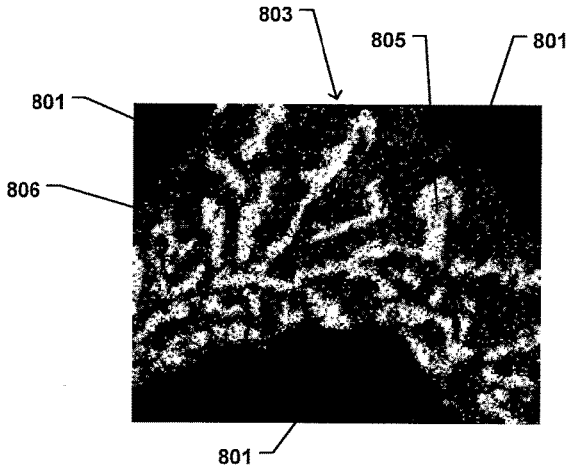

FIG. 5 includes a magnified image of the region of FIGS. 3 and 4, using microprobe analysis to identify select elements present in certain regions of the bonded abrasive body. FIG. 5 uses a microprobe in a mode set to identify regions having tin present, such that the lighter regions indicate regions where tin is more prevalent. As illustrated, the precipitated phase 805 of the bond material 803 has a greater content of tin than the bond phase 806.

Figure 6:
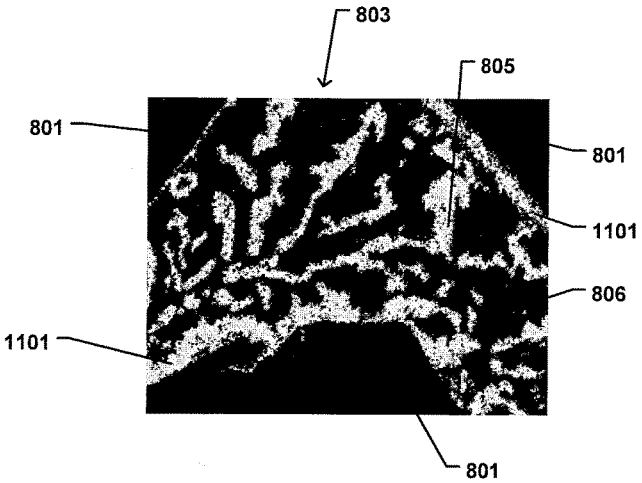

FIG. 6 includes a magnified image of the region of FIG. 3-5, using microprobe analysis. In particular, FIG. 6 uses a microprobe in a mode set to identify regions having titanium present, such that the lighter regions indicate regions where titanium is more prevalent. As illustrated, the precipitated phase 805 of the bond material 803 has a greater content of titanium than the bond phase 806. FIG. 6 also provides evidence of the interfacial phase 1101 at the interface of the abrasive particles 801 and the bond material 803. As evidenced by FIG. 6, the interfacial phase 1101 includes a particularly high content of titanium, indicating that the titanium of the active bond composition precursor may preferentially migrate to the interface of the particulate (i.e., abrasive particles 801) and chemically react with the abrasive particles to form an interracial phase compound as described herein.

FIGS. 3-6 provide evidence of an unexpected phenomenon. While it is not completely understood, the original bond material comprising copper and tin is separated during processing, which is theorized to be due to the liquid phase sintering process. The tin and copper become distinct phases; the precipitated phase 805 and the bond phase 806, respectively. Moreover, the tin preferentially combines with the titanium, present in the active bond composition precursor material to form the precipitated phase 805.

In accordance with an embodiment, the bonded abrasive body may include at least about 1 vol. % of the active bond composition, which includes all phases of the active bond composition, such as the interfacial phase and the precipitate phase, for the total volume of the bond material. In other instances, the amount of active bond composition within the bond material may be greater, such at least about 4 vol. %, at least about 6 vol. %, at least about 10 vol. %, at least about 12 vol. %, at least about 14 vol. %, at least about 15 vol. %, or even at least about 18 vol. % for the total volume of the bond material. In other instances, the amount of active bond composition within the bond material may be not greater than about 40 vol. %, not greater than about 35 vol. %, not greater than about 30 vol. %, not greater than about 25 vol. % or even not greater than about 18 vol. % for the total volume of the bond material. It will be appreciated that the amount of active bond composition within the bond material may be within a range between any of the minimum and maximum values listed herein. In particular instances, the bond material contains an amount of active bond composition within the range between about 1 vol. % and about 40 vol. %, such as between about 1 vol. % and 30 vol. %, between about 1 vol. % and about 25 vol. %, between about 4 vol. % and about 25 vol. %, or between about 6 vol. % and about 25 vol. %. In some instances, the amount of active bond composition is within a range between about 10 vol. % and about 30 vol. %, between about 10 vol. % and about 25 vol. %, or even between about 12 vol. % and about 20 vol. % of the total volume of the bond material.

The bonded abrasive body may be formed such that the bond material may have a particular fracture toughness ($K_{1c}$). The toughness of the bond material may be measured via a micro-indentation test or nano-indentation test. Micro-indentation testing measures the fracture toughness through a principle of generating cracks on a polished sample through loading an indentor at a particular location within the material, including for example in the present instance, in the bond material. For example, a suitable micro-indentation test may be conducted according to the methods disclosed in "Indentation of Brittle materials", Microindentation Techniques in Materials Science and Engineering, ASTM STP 889, D. B. Marshall and B. R. Lawn pp 26-46. In accordance with an embodiment, the bonded abrasive body has a bond material having an average fracture toughness ($K_{1c}$) of not greater than about 4.0 MPa $m^{0.5}$. In other embodiments, the average fracture toughness ($K_{1c}$) of the bond material may be not greater about 3.75 MPa $m^{0.5}$, such as not greater about 3.5 MPa $m^{0.5}$, not greater about 3.25 MPa $m^{0.5}$, not greater about 3.0 MPa $m^{0.5}$, not greater about 2.8 MPa $m^{0.5}$, or even not greater about 2.5 MPa $m^{0.5}$. In other embodiments, the average fracture toughness ($K_{1c}$) of the bond material may be at least about 0.6 MPa $m^{0.5}$, at least about 0.8 MPa $m^{0.5}$, at least about 1.0 MPa $m^{0.5}$, at least about 1.5 MPa $m^{0.5}$, at least about 2.0 MPa $m^{0.5}$ or even at least about 2.5 MPa $m^{0.5}$. It will be appreciated that the fracture toughness of the bond material may be within a range between any of the minimum and maximum values described herein. In particular instances, the average fracture toughness of the bond material may be within a range between about 0.6 MPa $m^{0.5}$ about 4.0 MPa $m^{0.5}$, such as within a range between about 0.6 MPa $m^{0.5}$ about 3.5 MPa $m^{0.5}$, or even within a range between about 0.6 MPa $m^{0.5}$ about 3.0 MPa $m^{0.5}$.

The abrasive articles of the embodiments herein may have particular properties. For example, the bonded abrasive body may have a modulus of rupture (MOR) of at least about 2000 psi, such as at least about 4000 psi, and more particularly, at least about 6000 psi.

The bonded abrasive bodies of the embodiments herein demonstrate particular advantageous properties when used in certain grinding operations. In particular, the bonded abrasive wheels may be used in non-truing and non-dressed grinding operations, wherein the bonded abrasive body does not require a truing or dressing operation during the grinding of a single or multiple workpieces, for example the grinding of threads in a carbide workpiece.

Traditionally, truing operations are completed to give the abrasive body a desired contour and shape. When grinding hard workpieces, for example, workpieces having a fracture toughness greater than about 5.5 MPa $m^{0.5}$ the abrasive body may require truing during the operation. After truing, the abrasive body is dressed, typically with an equally hard or harder abrasive element to remove worn particle and expose new abrasive particles. Dressing is a time consuming and necessary process for conventional abrasive articles to ensure proper operation of the abrasive article.

In particular embodiments described herein, the grinding cycles using abrasive articles described herein may be completed in a consecutive manner, which means no truing or dressing operations are conducted on the bonded abrasive article during the grinding cycles.

Truing and dressing of the abrasive tool described in embodiments herein may then be performed by a single tool in a single step following the grinding of the work piece. In certain embodiments, dressing may include plunge dressing the abrasive article.

The bonded abrasive bodies of the embodiments herein have been found to require significantly less dressing during use and have performance parameters that are significantly improved over conventional abrasive articles. In other particular embodiments, the boded abrasive bodies may be substantially self-dressing, such that some of the bond material can break away during grinding thereby exposing new surfaces of the abrasive particle.

In certain example embodiments, during a non-dressed grinding operation, the bonded abrasive body of an embodiment, may have a power variance of not greater than about 40%, wherein power variance is described by the equation [(Po−Pn)/Po]×100%. Po represents the grinding power (Hp or Hp/in) to grind a workpiece with the bonded abrasive body at an initial grinding cycle and Pn represents the grinding power (Hp or Hp/in) to grind the workpiece for a $n^{th}$ grinding cycle, wherein n≥4. Accordingly, the power variance measures the change in grinding power from an initial grinding cycle to a subsequent grinding cycle, wherein at least 4 grinding cycles are undertaken.

In certain other example embodiments, the bonded abrasive bodies of the embodiments herein may have a power variance of not greater than about 25% during certain grinding operations. In still other embodiments, the power variance of the bonded abrasive body may be not greater than about 20%, such as not greater than about 15%, or even not greater than about 12%. The power variance of certain abrasive bodies may be within a range between about 1% and about 40%, such as between about 1% and about 20%, or even between about 1% and about 12%.

In further reference to the power variance, it will be noted that the change in grinding power between the initial grinding cycle (Po) and the grinding power used to grind the workpiece at an nth grinding cycle (Pn) may be measured over a number of grinding cycles wherein "n" is greater than or equal to 4. In other instances, "n" may be greater than or equal to 6 (i.e., at least 6 grinding cycles), greater than or equal to 10, or even greater than or equal to 12. Moreover, it will be appreciated that the nth grinding cycle can represent consecutive grinding cycles, wherein dressing is not completed on the abrasive article between the grinding cycles.

In accordance with an embodiment, the bonded abrasive body may be used in grinding operations, wherein the material removal rate (MRR') is at least about 1.0 $in^3$/min/in [10 $mm^3$/sec/mm]. In other embodiments, a grinding operation using a bonded abrasive body of embodiments herein, may be conducted at a material removal rate of at least about 2 $in^3$/min/in [20 $mm^3$/sec/mm], at least about 4.0 $in^3$/min/in [40 $mm^3$/sec/mm], such as at least about 6.0 $in^3$/min/in [60 $mm^3$/sec/mm], at least about 7.0 $in^3$/min/in [70 $mm^3$/sec/mm], or even at least about 8.0 $in^3$/min/in [80 $mm^3$/sec/mm]. Certain grinding operations utilizing the bonded abrasive bodies of embodiments herein may be conducted at a material removal rate (MRR') within a range between about 1.0 $in^3$/min/in [10 $mm^3$/sec/mm] and about 20 $in^3$/min/in [200 $mm^3$/sec/mm], within a range between about 5.0 $in^3$/min/in [50 $mm^3$/sec/mm] and about 18 $in^3$/min/in [180 $mm^3$/sec/mm], within a range between about 6.0 $in^3$/min/in [60 $mm^3$/sec/mm] and about 16 $in^3$/min/in [160 $mm^3$/sec/mm], or even within a range between about 7.0 $in^3$/min/in [70 $mm^3$/sec/mm] and about 14 $in^3$/min/in [140 $mm^3$/sec/mm]. Furthermore, in certain embodiments, the particular MRR' described above may be achieved while concurrently producing a low maximum chip size in the workpiece, and particularly on the edge of the workpiece, as described in more detail below.

Moreover, the bonded abrasive body may be utilized in grinding operations wherein the bonded abrasive body is rotated at particular surface speeds. Surface speed refers to the speed of the wheel at the point of contact with the workpiece. For example, the bonded abrasive body may be rotated at a speed of at least 1500 surface feet per minute (sfpm), such as at least about 1800, such as at least about 2000 sfpm, at least about 2500 sfpm, at least about 5000 sfpm, or even at least 10000 sfpm. In particular instances, the bonded abrasive body may be rotated at a speed within a range between about 2000 sfpm and about 15000 sfpm, such as between about 2000 sfpm and 12000 sfpm.

In other embodiments, during grinding with bonded abrasive articles of embodiments herein, the average surface roughness variance for at least three consecutive grinding operations may be not greater than about 35%. It should be noted that consecutive grinding operations are operations wherein a truing operation is not conducted between each of the grinding operations. Moreover, between consecutive grinding operations, there is a period where no contact occurs between the abrasive body and the workpiece. The period of time at which no contact occurs may be a time sufficient to change the workpiece. The variance in the average surface roughness may be calculated as a standard deviation of the measured average surface roughness (Ra) of the workpiece at each of the locations on the workpiece, where each separate grinding operation is conducted. In accordance with certain embodiments, the average surface roughness variance for at least three consecutive grinding operations may be not greater than about 25%, not greater than about 20%, not greater than about 15%, not greater than about 10%, or even not greater than about 5%.

In accordance with other embodiments, the bonded abrasive article may have a G-ratio of at least about 1200. The G-ratio is the volume of material removed from the workpiece divided by the volume of material lost from the bonded abrasive body through wear. In accordance with another embodiment, the bonded abrasive body may have a G-ratio of at least about 1300, such as at least about 1400, at least about 1500, at least about 1600, at least about 1700, or even at least about 1800. In certain instances, the G-ratio of the bonded abrasive body may be within a range between about 1200 and about 2500, such as between about 1200 and about 2300, or even between about 1400 and about 2300. The G-ratio values noted herein may be achieved at the material removal rates noted herein. Moreover, the G-ratio values described may be achieved on a variety of workpiece material types described herein.

In comparison of the bonded abrasive bodies of embodiments described herein to conventional bonded abrasive bodies, such as abrasive bodies described in the examples of US Patent Application Publication No. 2012/0055098 A1, which is incorporated herein by reference in its entirety for all useful purposes, conventional bonded abrasive bodies can not grind precision threads, for example, threads having a grinded root radius between the threads on the workpiece of not greater than about 0.002 inches when the workpiece has a fracture toughness of at least about 5.5 $MPa \cdot m^{0.5}$, for example a carbide workpiece as described in embodiments herein. In particular, conventional boned abrasive bodies require truing and redressing during the grinding process.

Another noteworthy improvement in grinding performance of embodiments describe herein as measured in the industry is parts/dress, which is a measure of the number of parts that may be machined by a particular abrasive article before the abrasive article requires dressing to maintain performance. According to one embodiment, the bonded abrasive bodies of the embodiments herein may have an increase in grinding efficiency on a workpiece, as measured by parts/dress, of at least about 10% compared to a conventional metal-bonded abrasive article. According to another embodiment, the increase in grinding efficiency is at least about 20%, such as at least about 30%, at least about 40%, or even at least about 50% as compared to conventional metal-bonded abrasive articles. Notably, such conventional metal-bonded abrasive articles may include state of the art articles such as G-Force and Spector brand abrasive articles available from Saint-Gobain Corporation. In particular instances, the increase in grinding efficiency as measured by parts/dress may be within a range between about 10% and about 200%, such as on the order of between about 20% and about 200%, between about 50% and about 200%, or even between about 50% and about 150%. It will be appreciated, that such improvements may be achieved on workpieces described herein under the grinding conditions described herein. Notably, such improvements in the grinding efficiency may be achieved while maintaining other grinding parameters noted herein. For example, improvements in maintaining a constant tip radius on the abrasive article during grinding operations.

Additionally, the bonded abrasive articles of embodiments herein may have an improvement in grinding performance as measured in the industry by wear rate, which is a measure of the wear an abrasive article experiences during grinding. According to one embodiment, the bonded abrasive bodies of the embodiments herein may have an improvement in wear rate, such that the abrasive article wears at a rate that is at least 5% less than the wear rate of a conventional metal-bonded abrasive article. According to another embodiment, the wear rate is at least about 8% less, such as at least about 10%, at least about 12%, or even at least about 15% as compared to conventional metal-bonded abrasive articles. In particular instances, the improvement in wear rate may be within a range between about 5% and about 100%, such as on the order of between about 5% and about 75%, between about 5% and about 60%, or even between about 5% and about 50%. It will be appreciated, that such improvements may be achieved on workpieces described herein under the grinding conditions described herein.

Another noted improvement in grinding performance demonstrated by the abrasive articles of the embodiments described herein includes maintaining or even increasing useable grinding rate while improving the workpiece quality as described herein. Grinding rate is the speed at which a workpiece may be shaped without sacrificing the surface finish or exceeding the grinding power of the machine or bonded abrasive article. According to one embodiment, the bonded abrasive bodies of the embodiments herein may have an improvement in grinding rate, such that the abrasive article can grind at a rate that is at least 5% faster than a conventional metal-bonded abrasive article. In other instances, the grinding rate may be greater, such as at least about 8% less, at least about 10%, at least about 12%, at least about 15%, at least about 20%, or even at least about 25% as compared to conventional metal-bonded abrasive articles. For certain bonded abrasive articles herein, the improvement in grinding rate may be within a range between about 5% and about 100%, such as on the order of between about 5% and about 75%, between about 5% and about 60%, or even between about 5% and about 50%. It will be appreciated, that such improvements may be achieved on workpieces described herein under the grinding conditions described herein.

EXAMPLES

The following examples include a description of a set of example abrasive wheels prepared according to embodiments described herein, an example conventional abrasive wheel, and comparison of the performance of both sets of wheels.

Table 1 summarizes the abrasive wheel details, machining parameters and dressing parameters for example abrasive wheels (S1 and S2) and an example conventional abrasive wheel (C1). The example abrasive wheels (S1 and S2) were formed according to embodiments described herein.

TABLE 1

| Example Abrasive Wheels | | | |
|---|---|---|---|
| Example # | C1 | S1 | S2 |
| Abrasive Wheel Details | | | |
| Abrasive size (microns) | | 10 to 20 | 6 to 12 |
| Abrasive type | | Single crystal | Single crystal |
| Bond type | Vitrified (glass) | Metal | Metal |
| Machine Parameters (Tap Grinder) | | | |
| Coolant | Oil | Oil | Oil |
| Dresser Parameters | | | |
| Dresssing Roll Type | Diamond roll | Diamond roll | Diamond roll |
| Dressing Roll Speed (rpm) | 4000 to 5000 | 4000 | 5000 |
| Surface speed (feet/min) | 4500 to 6000 | 4712 | 5890 |
| Depth of cut (microns) | 2.5 | 2.5 | 2.5 |
| Traverse rate (in/min) | 1 | 1 | 1 |

Table 2 summarizes testing parameters for comparing example abrasive wheels S1 and S2 to the example conventional abrasive wheel C1 and the results of the comparison testing.

TABLE 2

| Performance Testing | | | |
|---|---|---|---|
| Example # | C1 | S1 | S2 |
| Performance Test Parameters | | | |
| Work material | tungsten carbide | tungsten carbide | tungsten carbide |
| Starting Work Diameter-Major diameter (in) | 0.118 | 0.118 | 0.118 |
| Work diameter at end (Root diameter), in | 0.08 | 0.08 | 0.080" |
| Performance Test Results | | | |
| Frequency of dressing for grinding one tap | twice | once | once |
| Tip radius flat, in | <0.002 | 0.0014-0.0018 | 0.0009-0.0013 |
| Base radius flat, in | <0.002 | 0.0014-0.0018 | 0.0011-0.0017 |
| Total cycle time, min | 7 min 16 secs | 3 min 8 secs | 3 min 8 secs |

Performance testing was carried out on a tap grinder capable of grinding high-precision taps of steel or tungsten carbide (i.e., grinding threads in workpieces having a fracture toughness of at least about 5.5 $MPa \cdot m^{0.5}$). All abrasive wheels (S1, S2 and C1) were dressed using a diamond roll so that they had a shape capable of generating the desired geometry of single rib threads in a tap for purposes of comparison testing. The parameters for dressing are shown above in Table 1.

Once the example abrasive wheels (S1, S2 and C1) were dressed to the desired geometry, each wheel was used to grind a full set of threads in a tungsten carbide tap, having a diameter of 0.118" and a pitch of 0.0197". The "tip radius flat" and "base radius flat" of the threads were measured on each tap to assure that all threads grinded into the given tap were within 0.002" or each other.

The example convention abrasive wheel (C1) lost its tip geometry before completing the grinding of threads on the entire length of the tap and had to be dressed a second time in order to complete the grinding of the entire set of threads in the workpiece to the desired parameters. Both example abrasive wheels S1 and S2, prepared according to embodiments described herein ground the entire set of threads on the tap to the required parameters in only one pass (i.e., the example abrasive wheels S1 and S2 required only one dressing). Notably, since abrasive wheels S1 an S2 required only one dressing, they completed grinding of the full set of threads into the tap in half the cycle time that was required for the example conventional abrasive wheel (CS1).

The bonded abrasive bodies herein demonstrate compositions and grinding properties that are distinct from conventional metal-bonded and vitrified abrasive articles. The bonded abrasive bodies of the embodiments herein demonstrate improved lifetime of effective grinding, require significantly less dressing than other conventional metal-bonded abrasive bodies, and have improved wear properties as compared to state-of-the-art metal-bonded abrasive bodies.

Furthermore, particular aspects of the forming process for the bonded abrasive bodies herein are thought to be responsible for certain compositions and microstructural features. The bonded abrasive bodies of embodiments herein include a combination of features, which may be attributed to the forming process and facilitate improved grinding performance, including for example, an active bond composition, particular phases of the active bond composition and particular locations of such phases, type and amount of porosity, type and amount and size of abrasive particles, type and amount of fillers, ratios of particulate to bond, ratios of abrasive to bond, tip radius of the abrasive article and mechanical properties (e.g., fracture toughness) of certain components.

In the foregoing, reference to specific embodiments and the connections of certain components is illustrative. It will be appreciated that reference to components as being coupled or connected is intended to disclose either direct connection between said components or indirect connection through one or more intervening components to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The disclosure will not be used to interpret or limit the scope or meaning of the claims. In addition, in the foregoing description includes various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments.

Item 1. An abrasive article configured to grind a workpiece having a fracture toughness of at least about 5.5 $MPa \cdot m^{0.5}$ comprising: a body comprising abrasive particles contained within a bond material comprising a metal, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive particles have an average particle size of at least about 1 micron and not greater than about 20 microns.

Item 2. An abrasive article configured to grind threads on a workpiece comprising a carbide, the abrasive article comprising: a body comprising abrasive particles contained within a bond material comprising a metal, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive particles comprise diamonds, wherein the diamonds are synthetic and wherein the diamonds are single crystal.

Item 3. An abrasive article configured to grind threads on a workpiece comprising a carbide, the abrasive article comprising: a body comprising abrasive particles contained within a bond material comprising a metal and an active bond composition, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the active bond composition is chemically bonded to at least a portion of a surface of at least a portion of the abrasive particles.

Item 4. An abrasive article configured to grind threads on a workpiece comprising a carbide, the abrasive article comprising: a body comprising abrasive particles contained within a bond material comprising a metal, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the body includes a porosity of at least about 30 vol. % for the total volume of the body.

Item 5. An abrasive article configured to grind threads on a workpiece comprising a carbide, the abrasive article comprising: a body comprising abrasive particles contained within a bond material comprising a metal alloy of tin and copper, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the metal alloy comprises a Sn/Cu ratio of not greater than about 0.65 by weight.

Item 6. An abrasive article configured to grind threads on a workpiece comprising a carbide, the abrasive article comprising: a body comprising abrasive particles contained within a bond material comprising a metal, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive article comprises a tip radius of not greater than about 0.002 inches.

Item 7. An abrasive article configured to grind threads on a workpiece comprising a carbide, the abrasive article comprising: a body comprising abrasive particles contained within a bond material comprising a metal, wherein the body comprises a ratio of $V_{AG}/V_{BM}$ of at least about 1.3, wherein $V_{AG}$ is a volume percent of abrasive particles within a total volume of the body and $V_{BM}$ is a volume percent of bond material within the total volume of the body, and wherein the abrasive article produces a grinded root tip radius of not greater than about 0.002 inches.

Item 8. A method of forming an abrasive article configured to grind threads on a workpiece comprising a carbide, the method comprising: providing a mixture including abrasive particles and bond material, wherein the bond material comprises a metal; and forming an abrasive body including the abrasive particles contained within the bond material, wherein the body comprises a ratio of $V_P$:$V_{BM}$ of at least about 3:2, wherein $V_P$ is a volume percent of particulate material including abrasive particles and fillers within a total volume of the body and $V_{BM}$ is a volume percent of bond material within the total volume of the body, and wherein the abrasive article comprises a tip radius of not greater than about 0.002 inches.

Item 9. A method of forming threads on a workpiece comprising a carbide, the method comprising: moving a bonded abrasive article relative to the workpiece to form a grinded root tip radius on the workpiece of not greater than about 0.002 inches; and truing and dressing the bonded abrasive article using a single tool in a single step.

Item 10. The abrasive article or method of any one of the preceding items, wherein the abrasive particles have an average particle size of at least about 1 micron and not greater than about 20 microns.

Item 11. The abrasive article or method of any one of the preceding items, wherein the abrasive particles have an average particle size of at least about 1 micron, at least about 2 microns, at least about 3 microns, at least about 4 microns, at least about 5 microns, at least about 6 microns, at least about 7 microns, at least about 8 microns, at least about 9 microns, at least about 10 microns, at least about 11 microns, at least about 12 microns, at least about 13 microns, at least about 14 microns, at least about 15 microns, at least about 16 microns, at least about 17 microns, at least about 18 microns and at least about 19 microns.

Item 12. The abrasive article or method of any one of the preceding items, wherein the abrasive particles have an average particle size of not greater than about 20 microns, not greater than about 19 microns, not greater than about 18 microns, not greater than about 17 microns, not greater than about 16 microns, not greater than about 15 microns, not greater than about 14 microns, not greater than about 13 microns, not greater than about 12 microns, not greater than about 11 microns, not greater than about 10 microns, not greater than about 9 microns, not greater than about 8 microns, not greater than about 7 microns, not greater than about 6 microns, not greater than about 5 microns, not greater than about 4 microns and not greater than about 3 microns.

Item 13. The abrasive article or method of any one of the preceding items, wherein the abrasive particles comprise diamonds, wherein the diamonds are synthetic and wherein the diamonds are single crystal.

Item 14. The abrasive article or method of any one of the preceding items, wherein the bond material comprises an active bond composition chemically bonded to at least a portion of a surface of at least a portion of the abrasive particles.

Item 15. The abrasive article or method of any one of the preceding items, wherein the abrasive article further comprises an active bond composition distinct from the bond material.

Item 16. The abrasive article or method of any one of the preceding items, wherein the bond material comprises at least about 1 vol. %, at least about 4 vol. %, at least about 14 vol. %, at least about 15 vol. %, and at least about 18 vol. % active bond composition for the total volume of the bond material.

Item 17. The abrasive article or method of any one of the preceding items, wherein the bond material comprises not greater than about 40 vol. %, not greater than about 35 vol. %, not greater than about 30 vol. %, not greater than about 25 vol. % and not greater than about 18 vol. % active bond composition for the total volume of the bond material.

Item 18. The abrasive article or method of any one of the preceding items, wherein the active bond composition comprises a compound including a metal or metal alloy.

Item 19. The abrasive article or method of any one of the preceding items, wherein the active bond composition comprises a metal element selected from the group of metal elements consisting of titanium, vanadium, chromium, zirconium, hafnium, tungsten, and a combination thereof.

Item 20. The abrasive article or method of any one of the preceding items, wherein the active bond composition comprises titanium.

Item 21. The abrasive article or method of any one of the preceding items, wherein the active bond composition consists essentially of titanium carbide.

Item 22. The abrasive article or method of any one of the preceding items, wherein the active bond composition surrounds at least a portion of the abrasive particles.

Item 23. The abrasive article or method of any one of the preceding items, wherein the active bond composition surrounds a majority of the abrasive particles.

Item 24. The abrasive article or method of any one the preceding items, wherein the active bond composition comprises a compound selected from the group consisting of carbides, nitrides, oxides, and a combination thereof.

Item 25. The abrasive article or method of any one of the preceding items, wherein the active bond composition is disposed at an interface of the abrasive particles and the bond material.

Item 26. The abrasive article or method of any one of the preceding items, wherein the abrasive article is configured to grind a workpiece having a fracture toughness of at least about 5.5 $MPa \cdot m^{0.5}$.

Item 27. The abrasive article or method any one of the preceding items, wherein the abrasive article is configured to grind a workpiece having a fracture toughness of at least about 5.6 $MPa \cdot m^{0.5}$, at least about 5.7 $MPa \cdot m^{0.5}$, at least about 5.8 $MPa \cdot m^{0.5}$, at least about 5.9 $MPa \cdot m^{0.5}$, at least about 6.0 $MPa \cdot m^{0.5}$, at least about 6.2 $MPa \cdot m^{0.5}$, at least about 6.4 $MPa \cdot m^{0.5}$, at least about 6.6 $MPa \cdot m^{0.5}$ at least about 6.8 $MPa \cdot m^{0.5}$, at least about 7.0 $MPa \cdot m^{0.5}$, at least about 7.5 $MPa \cdot m^{0.5}$, at least about 8.0 $MPa \cdot m^{0.5}$, at least about 9.0 $MPa \cdot m^{0.5}$, at least about 10.0 $MPa \cdot m^{0.5}$, at least about 15.0 $MPa \cdot m^{0.5}$ and at least about 19.0 $MPa \cdot m^{0.5}$.

Item 28. The abrasive article or method of any one of the preceding items, wherein the abrasive article is configured to grind a workpiece having a fracture toughness of not greater than about 20.0 $MPa \cdot m^{0.5}$, not greater than about 15.0 $MPa \cdot m^{0.5}$, not greater than about 10.0 $MPa \cdot m^{0.5}$, not greater than about 9.0 MPa·m$^{0.5}$, not greater than about 8.0 MPa·m$^{0.5}$, not greater than about 7.5 MPa·m$^{0.5}$, not greater than about 7.0 MPa·m$^{0.5}$, not greater than about 6.8 MPa·m$^{0.5}$, not greater than about 6.6 MPa·m$^{0.5}$, not greater than about 6.4 MPa·m$^{0.5}$, not greater than about 6.2 MPa·m$^{0.5}$, not greater than about 6.0 MPa·m$^{0.5}$, not greater than about 5.9 MPa·m$^{0.5}$, not greater than about 5.8 MPa·m$^{0.5}$, not greater than about 5.7 MPa·m$^{0.5}$ and not greater than about 5.6 MPa·m$^{0.5}$.

Item 29. The abrasive article or method of any one of the preceding items, wherein the bond material comprises a metal alloy of tin and copper.

Item 30. The abrasive article or method of any one of the preceding items, wherein the metal alloy comprises a $C_{SN}/C_{Cu}$ ratio of not greater than about 0.65.

Item 31. The abrasive article or method of any one of the preceding items, wherein the bond material comprises a $C_{Sn}/C_{Cu}$ alloy having a $C_{Sn}/C_{Cu}$ ratio of not greater than about 0.64, not greater than about 0.63, not greater than about 0.62, not greater than about 0.61, not greater than about 0.60, not greater than about 0.59, not greater than about 0.58, not greater than about 0.57, not greater than about 0.56, not greater than about 0.55, not greater than about 0.54, not greater than about 0.53, not greater than about 0.52, not greater than about 0.51, not greater than about 0.50, not greater than about 0.49, not greater than about 0.48, not greater than about 0.47, not greater than about 0.46, not greater than about 0.45, not greater than about 0.44, not greater than about 0.43, not greater than about 0.42, not greater than about 0.41, not greater than about 0.40, not greater than about 0.39, not greater than about 0.38, not greater than about 0.37, not greater than about 0.36, not greater than about 0.35, not greater than about 0.34, not greater than about 0.33, not greater than about 0.32, not greater than about 0.31, not greater than about 0.30, not greater than about 0.28, not greater than about 0.26, not greater than about 0.24, not greater than about 0.22, not greater than about 0.20, not greater than about 0.15 and not greater than about 0.12.

Item 32. The abrasive article or method of any one of the preceding items, wherein the bond material comprises a $C_{Sn}/C_{Cu}$ alloy having a $C_{Sn}/C_{Cu}$*ratio of at least about 0.10, at least about 0.15, at least about 0.20, at least about 0.22, at least about 0.24, at least about 0.26, at least about 0.28, at least about 0.30, at least about 0.31, at least about 0.32, at least about 0.33, at least about 0.34, at least about 0.35, at least about 0.36, at least about 0.37, at least about 0.38, at least about 0.39, at least about 0.40, at least about 0.41, at least about 0.42, at least about 0.43, at least about 0.44, at least about 0.45, at least about 0.46, at least about 0.47, at least about 0.48, at least about 0.49, at least about 0.50, at least about 0.51, at least about 0.52, at least about 0.53, at least about 0.54, at least about 0.55, at least about 0.56, at least about 0.57, at least about 0.58, at least about 0.59, at least about 0.60, at least about 0.61, at least about 0.62, at least about 0.63 and at least about 0.64.

Item 33. The abrasive article or method of any one of the preceding items, wherein the body comprises at least about 30 vol. % porosity.

Item 34. The abrasive article or method of any one of the preceding items, wherein the body comprises at least about 35 vol. %, at least about 40 vol. %, at least about 45 vol. %, at least about 50 vol. %, at least about 55 vol. %, at least about 60 vol. %, at least about 65 vol. %, at least about 70 vol. % and at least about 75 vol. % porosity of the total volume of the body.

Item 35. The abrasive article or method of any one of the preceding items, wherein the body comprises not greater than about 80 vol. %, not greater than about 75 vol. %, not greater than about 70 vol. %, not greater than about 65 vol. %, not greater than about 60 vol. %, not greater than about 55 vol. %, not greater than about 50 vol. %, not greater than about 45 vol. %, not greater than about 40 vol. % and not greater than about 35 vol. % porosity of the total volume of the body.

Item 36. The abrasive article or method of any one of the preceding items, wherein a majority of the porosity is interconnected porosity defining a network of interconnected pores extending through the volume of the body.

Item 37. The abrasive article or method of any one of the preceding items, wherein the abrasive article comprises a tip radius of not greater than about 0.002 inches.

Item 38. The abrasive article or method of any one of the preceding items, wherein the abrasive article comprises a tip radius of not greater than about 0.0019 inches, not greater than about 0.0015 inches, not greater than about 0.0010 inches and not greater than about 0.0005 inches.

Item 39. The abrasive article or method of any one of the preceding items, wherein the abrasive article comprises a tip radius of at least about 0.0005 inches, at least about 0.0010 inches, at least about 0.0015 inches and at least about 0.0019 inches.

Item 40. The abrasive article or method of any one of the preceding items, wherein the abrasive article exhibits a grinded root tip radius of not greater than about 0.002 inches.

Item 41. The abrasive article or method of any one of the preceding items, wherein the abrasive article exhibits a grinded root tip radius of not greater than about 0.0019 inches, not greater than about 0.0015 inches, not greater than about 0.0010 inches and not greater than about 0.0005 inches.

Item 42. The abrasive article or method of any one of the preceding items, wherein the abrasive article exhibits a grinded root tip radius of at least about 0.0005 inches, at least about 0.0010 inches, at least about 0.0015 inches and at least about 0.0019 inches.

Item 43. The abrasive article or method of any one of the preceding items, wherein the abrasive particles comprise a superabrasive material.

Item 44. The abrasive article or method of any one of the preceding items, wherein the abrasive particles consist essentially of a superabrasive material.

Item 45. The abrasive article or method of any one of the preceding items, wherein the abrasive particles consist essentially of a CBN, diamond or a combination thereof.

Item 46. The abrasive article or method of any one of the preceding items, wherein the abrasive particles have an aspect ratio of not greater than about 2:1 and not greater than about 1.5:1, wherein aspect ratio is defined as a ratio of the dimensions length:width.

Item 47. The abrasive article or method of any one of the preceding items, wherein the abrasive particles are substantially equi-axed.

Item 48. The abrasive article or method of any one of the preceding items, wherein the bond material comprises at least one transition metal element.

Item 49. The abrasive article or method of any one of the preceding items, wherein the bond material comprises a metal selected from the group of metals consisting of copper, tin, silver, molybdenum, zinc, tungsten, iron, nickel, antimony, and a combination thereof.

Item 50. The abrasive article or method of any one of the preceding items, wherein the ratio of $V_{AG}/V_{BM}$ is at least about 1.5, at least about 1.7, at least about 2.0, at least about 2.1, and at least about 2.2, wherein $V_{AG}$ is a volume percent of abrasive particles within a total volume of the body and $V_{BM}$ is a volume percent of bond material within the total volume of the body.

Item 51. The abrasive article or method of any one of the preceding items, wherein the ratio of $V_{AG}/V_{BM}$ is not greater than about 9.0, not greater than about 8.0, not greater than about 7.0, not greater than about 6.0 and not greater than about 5.0, wherein $V_{AG}$ is a volume percent of abrasive particles within a total volume of the body and $V_{BM}$ is a volume percent of bond material within the total volume of the body.

Item 52. The abrasive article or method of any one of the preceding items, wherein the ratio of $V_{AG}/V_{BM}$ is within a range between about 1.3 and about 9.0, between about 1.3 and about 8.0, between about 1.5 and about 7.0, between about 1.5 and about 6.0, and between about 2.0 and about 5.0, wherein $V_{AG}$ is a volume percent of abrasive particles within a total volume of the body and $V_{BM}$ is a volume percent of bond material within the total volume of the body.

Item 53. The abrasive article or method of any one of the preceding items, wherein the bondmaterial comprises an average fracture toughness ($K_{1c}$) of not greater about 4.0 MPa $m^{0.5}$, not greater than about 3.75 MPa $m^{0.5}$, not greater about 3.5 MPa $m^{0.5}$, not greater about 3.25 MPa $m^{0.5}$, not greater about 3.0 MPa $m^{0.5}$, not greater about 2.8 MPa $m^{0.5}$ and not greater about 2.5 MPa $m^{0.5}$.

Item 54. The abrasive article or method of any one of the preceding items, wherein the bond material comprises an average fracture toughness ($K_{1c}$) of at least about 0.6 MPa $m^{0.5}$, at least about 0.8 MPa $m^{0.5}$, at least about 1.0 MPa $m^{0.5}$, at least about 1.5 MPa $m^{0.5}$, at least about 2.0 MPa $m^{0.5}$ and at least about 2.5 MPa $m^{0.5}$.

Item 55. The abrasive article or method of any one of the preceding items, wherein the bond material comprises an average fracture toughness ($K_{1c}$) within a range between about 0.6 MPa $m^{0.5}$ and about 4.0 MPa $m^{0.5}$, between about 0.6 MPa $m^{0.5}$ and about 3.5 MPa $m^{0.5}$, and between about 0.6 MPa $m^{0.5}$ and about 3.0 MPa $m^{0.5}$.

Item 56. The abrasive article or method of any one of the preceding items, wherein at least a portion of the abrasive particles comprise a coating.

Item 57. The abrasive article or method of any one of the preceding items, wherein the coating comprises a metal or metal alloy.

Item 58. The abrasive article or method of any one of the preceding items, wherein the coating comprises nickel.

Item 59. The abrasive article or method of any one of the preceding items, wherein the coating includes an electroplated metal layer applied to the abrasive particles.

Item 60. The abrasive article or method of any one of the preceding items, wherein the body further comprises fillers.

Item 61. The abrasive article or method of any one of the preceding items, wherein the fillers are natural materials.

Item 62. The abrasive article or method of any one of the preceding items, wherein the fillers are synthetic materials.

Item 63. The abrasive article or method of any one of the preceding items, wherein the fillers comprise a material selected from the group of materials consisting of oxides, carbides, borides, silicides, nitrides, oxynitrides, oxycarbides, silicates, graphite, silicon, inter-metallics, ceramics, hollow-ceramics, fused silica, glass, glass-ceramics, hollow glass spheres, and a combination thereof.

Item 64. The abrasive article or method of any one of the preceding items, wherein the fillers comprise a fracture toughness ($K_{1c}$) of not greater than about 10 MPa $m^{0.5}$, not greater than about 9 MPa $m^{0.5}$, not greater than about 8 MPa $m^{0.5}$ and not greater than about 7 MPa $m^{0.5}$.

Item 65. The abrasive article or method of any one of the preceding items, wherein the fillers comprise a fracture toughness ($K_{1c}$) of at least about 0.5 MPa $m^{0.5}$, at least about 1 MPa $m^{0.5}$ and at least about 2 MPa $m^{0.5}$.

Item 66. The abrasive article or method of any one of the preceding items, wherein the fillers comprise not greater than about 30 vol. %, not greater than about 25 vol. %, not greater than about 20 vol. %, not greater than about 15 vol. %, not greater than about 10 vol. % and not greater than about 5 vol. % of the total volume of the body.

Item 67. The abrasive article or method of any one of the preceding items, wherein the fillers comprise at least about 2 vol. %, at least about 5 vol. %, at least about 10 vol. %, at least about 15 vol. %, at least about 20 vol. % and at least about 25 vol. % of the total volume of the body.

Item 68. The abrasive article or method of any one of the preceding items, wherein the fillers are present in an amount less than an amount of the abrasive particles as measured by volume percent of the total volume of the body.

Item 69. The abrasive article or method of any one of the preceding items, wherein the body comprises a ratio of $V_P/V_{BM}$ of at least about 1.5, at least about 1.7, at least about 2.0 and at least about 2.2, wherein $V_P$ is a volume percent of particulate material including abrasive grains and fillers within a total volume of the body and $V_{BM}$ is a volume percent of bond material within the total volume of the body.

Item 70. The abrasive article or method of any one of the preceding items, wherein the body comprises a ratio of $V_P/V_{BM}$ of not greater than about 9.0, not greater than about 8.0, not greater than about 7.0 and not greater than about 6.0, wherein $V_P$ is a volume percent of particulate material including abrasive grains and fillers within a total volume of the body and $V_{BM}$ is a volume percent of bond material within the total volume of the body.

Item 71. The abrasive article or method of any one of the preceding items, wherein the ratio of $V_P/V_{BM}$ is within a range between about 1.5 and about 9.0 and within a range between about 1.5 and about 8.0, wherein $V_P$ is a volume percent of particulate material including abrasive grains and fillers within a total volume of the body and $V_{BM}$ is a volume percent of bond material within the total volume of the body.

What is claimed is:

1. An abrasive wheel configured to grind a workpiece having a fracture toughness of at least about 5.5 MPa·$m^{0.5}$ comprising:

a body comprising abrasive particles contained within a bond material comprising a metal and at least about 1 vol. % of an active bond composition for a total volume of the bond material, wherein the body comprises a ratio of $V_{AG}/V_{BM}$ of at least 1.7 and not greater than 9.0, wherein $V_{AG}$ is a volume percent of abrasive particles within a total volume of the body and $V_{BM}$ is a volume percent of bond material within the total volume of the body, wherein the abrasive particles have an average particle size of at least about 1 micron and not greater than about 20 microns, wherein the body comprises at least about 30 vol. % porosity, and wherein the abrasive wheel comprises a tip radius of not greater than 0.002 inches.

2. The abrasive wheel of claim 1, wherein the abrasive particles comprise diamonds, wherein the diamonds are synthetic and wherein the diamonds are single crystal.

3. The abrasive wheel of claim 1, wherein the active bond composition is chemically bonded to at least a portion of a surface of at least a portion of the abrasive particles.

4. The abrasive wheel of claim 1, wherein the bond material comprises at least about 1 vol. % and not greater than about 40 vol % for a total volume of the bond material.

5. The abrasive wheel of claim 1, wherein the ratio of $V_P/V_{BM}$ is within a range between about 1.5 and about 9.0, wherein $V_P$ is a volume percent of particulate material including abrasive grains and fillers within a total volume of the body and $V_{BM}$ is a volume percent of bond material within the total volume of the body.

6. An abrasive wheel configured to grind threads on a workpiece comprising a carbide, the abrasive wheel comprising:

a body comprising abrasive particles contained within a bond material comprising a metal and at least about 1 vol. % of an active bond composition for a total volume of the bond material, wherein the body comprises a ratio of $V_{AG}/V_{BM}$ of at least 1.7 and not greater than 9.0, wherein $V_{AG}$ is a volume percent of abrasive particles within a total volume of the body and $V_{BM}$ is a volume percent of bond material within the total volume of the body, wherein the abrasive wheel comprises a tip radius of not greater than about 0.002 inches, and wherein the body comprises at least about 30 vol. % porosity.

7. The abrasive wheel of claim 6, wherein the abrasive particles comprise diamonds, wherein the diamonds are synthetic and wherein the diamonds are single crystal.

8. The abrasive wheel of claim 6, wherein the abrasive particles have an average particle size of at least about 1 micron and not greater than about 20 microns.

9. The abrasive wheel of claim 6, wherein the abrasive wheel is configured to grind a workpiece having a fracture toughness of at least about 5.5 $MPa \cdot m^{0.5}$.

10. The abrasive wheel of claim 6, wherein the ratio of $V_P/V_{BM}$ is within a range between about 1.5 and about 9.0, wherein $V_P$ is a volume percent of particulate material including abrasive grains and fillers within a total volume of the body and $V_{BM}$ is a volume percent of bond material within the total volume of the body.

11. A method of forming an abrasive wheel configured to grind threads on a workpiece comprising a carbide, the method comprising:

providing a mixture including abrasive particles and bond material, wherein the bond material comprises a metal and at least about 1 vol. % of an active bond composition for a total volume of the bond material; and forming an abrasive body including the abrasive particles contained within the bond material, wherein the body comprises a ratio of $V_{AG}/V_{BM}$ of at least 1.7 and not greater than 9.0, wherein $V_{AG}$ is a volume percent of abrasive particles within a total volume of the body and $V_{BM}$ is a volume percent of bond material within the total volume of the body;

wherein the body comprises a ratio of $V_P:V_{BM}$ of at least about 3:2, wherein $V_P$ is a volume percent of particulate material including abrasive particles and fillers within a total volume of the body and $V_{BM}$ is a volume percent of bond material within the total volume of the body, wherein the abrasive wheel comprises a tip radius of not greater than about 0.002 inches, and wherein the body comprises at least about 30 vol. % porosity.

12. The abrasive wheel of claim 11, wherein the abrasive particles comprise diamonds, wherein the diamonds are synthetic and wherein the diamonds are single crystal.

13. The abrasive wheel of claim 11, wherein the abrasive particles have an average particle size of at least about 1 micron and not greater than about 20 microns.

14. The method of claim 11, wherein the abrasive wheel is configured to grind a workpiece having a fracture toughness of at least about 5.5 $MPa \cdot m^{0.5}$.

* * * * *